US005558559A

United States Patent [19]

Noguchi et al.

[11] Patent Number: 5,558,559

[45] Date of Patent: Sep. 24, 1996

[54] POLISHING SYSTEM FOR OPPOSITE EDGE FACES OF PLATED STEEL STRIP

[75] Inventors: Yukihiko Noguchi; Keitoshi Haruta; Isamu Sakamoto; Mituo Yamanaka, all of Ibaraki-ken; Makoto Uchinono; Takashi Shiohara, both of Yamaguchi-ken, all of Japan

[73] Assignee: Sumitomo Metal Industries, Ltd., Osaka, Japan

[21] Appl. No.: 289,540

[22] Filed: Aug. 12, 1994

[30] Foreign Application Priority Data

| | | | |
|---|---|---|---|
| Aug. 13, 1993 | [JP] | Japan | 5-044412 U |
| Aug. 13, 1993 | [JP] | Japan | 5-201717 |
| Aug. 13, 1993 | [JP] | Japan | 5-201718 |
| Apr. 5, 1994 | [JP] | Japan | 6-067356 |

[51] Int. Cl.[6] ..... B24B 49/00

[52] U.S. Cl. ..... 451/14; 451/54; 451/190; 451/188

[58] Field of Search ..... 451/190, 191, 451/192, 188, 207, 5, 14, 444, 449, 450, 445

[56] References Cited

U.S. PATENT DOCUMENTS

| | | | |
|---|---|---|---|
| 451,263 | 4/1891 | Buckman | 451/207 |
| 2,170,687 | 8/1939 | Johnson | 451/190 |
| 3,277,609 | 10/1966 | Horie et al. | 451/188 |
| 3,400,449 | 9/1968 | Maguire et al. | 451/54 |
| 3,702,489 | 11/1972 | Nakamura et al. | 451/190 |
| 4,461,124 | 7/1984 | Anderson | 451/190 |
| 5,119,595 | 6/1992 | Ushiyama et al. | 451/450 |

FOREIGN PATENT DOCUMENTS

| | | | |
|---|---|---|---|
| 0137595 | 4/1985 | European Pat. Off. . | |
| 184500 | 8/1922 | United Kingdom | 451/188 |
| 2044644 | 10/1980 | United Kingdom . | |
| 2102711 | 2/1983 | United Kingdom . | |
| WO89/01995 | 3/1989 | WIPO . | |

*Primary Examiner*—Bruce M. Kisliuk
*Assistant Examiner*—Derris H. Banks
*Attorney, Agent, or Firm*—Burns, Doane, Swecker & Mathis, L.L.P.

[57] ABSTRACT

This invention completely removes a plating layer on the edge faces of a plated steel strip. A polishing system 100 for opposite edge faces of a plated steel strip S wherein a plating layer on opposite edge faces of the plated steel strip S is removed, comprises: at least a pair of side face polishing devices 1 disposed along a traveling direction of the steel strip S for polishing opposite side faces of the steel strip S by a pair of rotary brushes 110*a* of said devices 1 opposed in the widthwise direction of the steel strip S being inclined in the same direction relative to the traveling direction of the steel strip S, one rotary brush 110*a* on a side face of the steel strip S being set to rotate downwardly thereon and the other adjacent rotary brush 110*a* on the same side as the one brush being set to rotate upwardly thereon in the case of providing more than two pairs of said side face polishing devices 1; a pressure roll 2 on a lower or upper edge face of the steel strip S when said rotary brush 110*a* polishes the side face of the steel strip S downwardly or upwardly; a detector 130 for detecting a change of a driving load; and a controller 140 for adjusting a position of said rotary brush 110*a*.

8 Claims, 19 Drawing Sheets

Fig. 19A (B21)
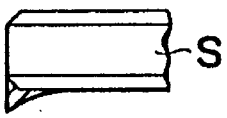
Fig. 19B (A21)
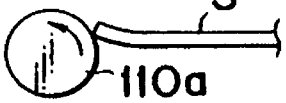
Fig. 19C (B11)
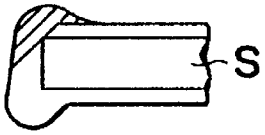
Fig. 19D (A11)
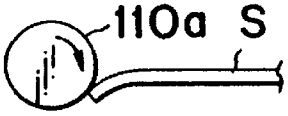
Fig. 19E (B22)
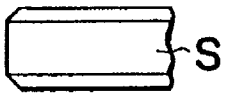
Fig. 19F (A22)
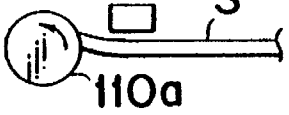
Fig. 19G (B12)
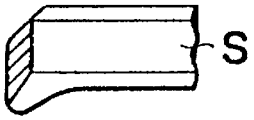
Fig. 19H (A12)
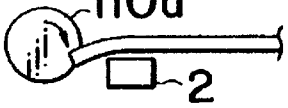
Fig. 19I (B23)
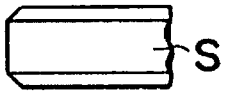
Fig. 19J (A23)
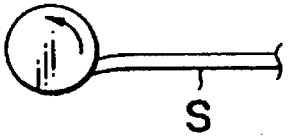
Fig. 19K (B13)
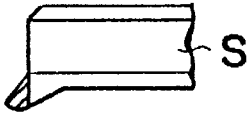
Fig. 19L (A13)
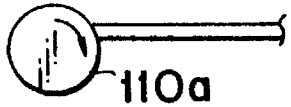

POLISHING SYSTEM FOR OPPOSITE EDGE FACES OF PLATED STEEL STRIP

BACKGROUND OF THE INVENTION (1) Field of the Invention

The present invention relates to a polishing system for longitudinal opposite edge faces of a plated steel strip.

(2) Statement of the Prior Art

In the continuous electroplating of the steel strip, a problem arises whereby when a plating electric current is concentrated at opposite edge faces of the steel strip, and consequently a so-called edge-over-coating phenomenon takes place, it results in a plating material being excessively deposited on ends of the steel strip. Since the plated coating which has been deposited excessively on opposite edge faces of the steel strip by the concentrated electric current is in the state of dendrite, and thus it is fragile and easily peeled off, dents will be created on the steel strip by fragments which will be peeled off during press forming operation etc. The edge faces as used herein include longitudinal side faces, upper and lower edge faces along a longitudinal direction on the steel strip.

The present applicant has previously proposed a solution in the Japanese Examined Patent Publication No. Hei 5-41385 entitled as "Polishing System for Opposite Side Faces of the Plated Steel Strip".

The prior art system and its relevant problem will be described hereinbelow, with reference to accompanying drawings for convenience of illustration, wherein;

FIG. 28 is a schematic side view of the prior art polishing system;

FIGS. 29A and 29B are pictorial views showing the edge face of the steel strip which has been warped;

FIGS. 30A–30C are pictorial views illustrating the prior art polishing system while it is being operated to polish the side face of the steel strip;

FIG. 31 is a plan view showing a positional relationship between the conventional cylindrical rotary brush and the steel strip while they are in contact each other;

FIG. 32 is a side view showing a surface where the rotary brush and the side face of the steel strip in FIG. 31 contact each other; and FIG. 33 is a front elevation showing a prior art cleaning water spray unit.

As shown in FIG. 28, the system as disclosed in the above-described patent publication is designed to remove a plated coating which has been adhered to opposite side surfaces on the steel strip S which has been plated on its dual surfaces, wherein the system comprises at least a pair of side face polishing devices 1 each being arranged along a traveling direction of the steel strip and being adapted to polish opposite side faces of the steel strip S by causing rotary brushes 110 to engage such opposite side faces of the steel strip S in such a manner that the brushes may oppose each other along a widthwise direction of the steel strip S, the rotary axes 111 of the rotary brushes 110 being inclined in the same direction relative to the traveling directions S, said rotary brushes being arranged to be adjacent to each other along the traveling direction of the steel strip S in the same plane of the steel strip, one of said rotary brushes being set to polish the side face on the steel strip from an upward direction to a downward direction, other of said rotary brushes being set to polish the side face from a downward direction to an upward direction, a detector for detecting a variation in a driving load in a motor which operates the rotary brush 110 for rotation, and wherein a signal is sent to a control board, and the control signal is sent to the motor which causes the rotary brushes 110 to travel in the widthwise direction of the steel strip S so as to adjust the position of the rotary brushes 110.

However, even if this system is used, the steel strip is caused to warp at its edge portion under rotary forces of the brush 110, as shown in FIGS. 29A and 29B. If a greater warp is caused to occur, then an adequate brushing effect by means of brush may not be expected.

As above-described, an excessive plating material may deposit on the opposite edge faces on the steel strip, as shown in FIG. 30A. In the case that the steel strip is caused to warp at edge portions under rotary forces of the brush 110, a portion will not be polished at the upper or the lower portion of the edge face of the steel strip as shown in FIG. 30B, after a polishing operation is carried out for the steel strip by means of usual rotary brushes.

An excessive plating portion g unavoidably may not be polished at the upper and the lower portions of the edge faces of the steel strip as shown in FIG. 30C, even when some means are provided to prevent the edge faces of the steel strip S from being warped. In the case, for example, that the conventional cylindrical rotary brush 110 is merely arranged, with an inclination against the edge face on the steel strip as shown in FIG. 31, a contacting face F with the brush may be provided, as shown in FIG. 32. In this case, the side face of the steel strip may be provided with a theoretical contacting face with the brush where no warp may occur. However, the excessive plate deposited portion g may not be eliminated. This reason will be described later.

Rail covers are provided to protect the slidable contact components of the system from the ingress of polishing dusts, and since the rail covers are caused to slide in an interleaving manner (that is, they move slidably in a partially overlapped manner), it may sometimes become impossible to move the rail covers when the polishing dusts have accumulated. Consequently, a portion or the entire length of the edge face on the steel strip will not be polished. For example, in the known system as above-described, removal of the polishing dusts which would fall and accumulate on the rail covers 164, as shown in FIG. 33, has not been concerned. If such polishing dusts are not removed, it may become hard to move the rail covers as above-described, and consequently a carriage cannot be moved.

SUMMARY OF THE INVENTION

A first object of the present invention is to provide a polishing system for opposite edge faces of a plated steel strip, which prevents warps of edge portions of a steel strip and problems due to deposition of polished chips on rail covers upon polishing the edge faces of the plated steel strip.

A second object of the present invention is to provide a polishing system for opposite edge faces of a plated steel strip, which can completely polish the edge faces by superimposing preformed reserve warps of the edge portions of the plated steel strip onto warps of the edge portions caused by rotary forces of rotary brushes upon polishing the edge faces of the plated steel strip to cancel both warps and which can prevent problems due to deposition of polished chips.

A third object of the present invention is to provide a polishing system for opposite edge faces of a plated steel strip, which can smoothly remove overplated portions of the edge faces of the strip.

In order to achieve the above objects, a polishing system for opposite edge faces of a plated steel strip wherein a plating layer on opposite edge faces of the plated steel strip is removed, in accordance with the present invention, comprises:

at least a pair of side face polishing devices disposed along a traveling direction of the steel strip for polishing opposite side faces of the steel strip by a pair of rotary brushes which engage with the opposite side faces in a widthwise direction, rotary axes of the rotary brushes of the devices opposed in the widthwise direction of the steel strip being inclined in the same direction relative to the traveling direction of the steel strip, one rotary brush on a side face of the steel strip being set to rotate downwardly thereon and the other adjacent rotary brush on the same side as the one brush being set to rotate upwardly thereon in the case of providing more than two pairs of the side face polishing devices;

a mechanism for adjusting warps of edge portions of the steel strip;

a detector for detecting a change of a driving load in a motor which drives the rotary brush; and a controller for adjusting a position of the rotary brush by applying a control signal to a motor which moves the rotary brush in the widthwise direction of the steel strip in response to the detected signal from the detector.

The adjusting mechanism is a pressure roll disposed on a lower or upper edge face of the steel strip when the rotary brush polishes the side face of the steel strip downwardly or upwardly.

The rotary brush may be formed into a hourglass like configuration.

A detector is secured to a support table for the rotary brushes for detecting a polishing position between the rotary brush and the side face of the steel strip, wherein a mechanism which displaces the pressure roll in the widthwise direction is secured to the brush support table. The controller transmits a control signal to the roll displacing mechanism in accordance with a detected signal from the polishing position detector.

A spray nozzle may be disposed below the rotary brush so that the nozzle removes polished chips deposited on sliding rail covers.

The warp adjusting mechanism forms an upward ramp path and a downward ramp path in a pass line of a steel strip passing between the opposite rotary brushes by at least three path rolls provided in a given spaced distance in the pass line. The mechanism insulates a tension caused in the ramp paths from other paths by wringer rolls provided on inlet and outlet sides of the ramp paths. The mechanism rotates the rotary brush downwardly or upwardly relative to the side face on the upward or downward ramp path.

The rotary brush may be formed into a hourglass like configuration.

The side face polishing devices may be disposed on either the upward or downward ramp path.

The side face polishing devices may be disposed on both upward and downward ramp paths.

The pressure roll is disposed on a lower or upper edge face of the steel strip when the rotary brush polishes the side face of the steel strip downwardly or upwardly.

A polishing system for opposite longitudinal edge faces of a plated steel strip wherein a plating layer on opposite edge faces of the plated steel strip is polished, in accordance with the present invention, comprises:

at least two pairs of side face polishing devices disposed along a traveling direction of the steel strip for polishing the opposite side faces of the steel strip by a pair of hourglass like rotary brushes which engage with the opposite side faces in a widthwise direction, rotary axes of the hourglass like rotary brushes of the devices opposed in the widthwise direction of the steel strip being inclined in the same direction relative to the traveling direction of the steel strip, rotary axes of the hourglass like rotary brushes adjacent to each other on the same side face of the steel strip being inclined in the reverse directions with each other, one hourglass like rotary brush on a side face of the steel strip being set to rotate downwardly thereon and the other adjacent hourglass like rotary brush on the same side as the one brush being set to rotate upwardly thereon;

a pressure roll disposed on a lower or upper edge face of the steel strip when the rotary brush polishes the side face of the steel strip downwardly or upwardly;

a first pressure roll displacing mechanism for displacing the pressure roll in a direction perpendicular to a surface of the steel strip;

a second pressure roll displacing mechanism mounted on a brush support table for supporting the first mechanism and for displacing it in the widthwise direction of the steel strip;

a polishing load adjusting device mounted on a base table for detecting a change of a driving load in a motor which drives the hourglass like rotary brush and for displacing the brush support table in the widthwise direction of the steel strip to adjust a brush polishing load;

a polishing position detector mounted on the brush support table for detecting a polishing position between the hourglass like rotary brush and the side face of the steel strip;

a pressure roll controller for controlling the second pressure roll displacing mechanism in response to a detected signal from the polishing position detector; and a warp detector mounted on the base plate for detecting a distance (warp amount) from an upper or lower edge face of the steel strip to the detector, the pressure roll controller controlling the first pressure roll displacing mechanism in response to a detected signal from the warp detector.

A polishing system for opposite edge faces of a plated steel strip wherein a plating layer on opposite edge faces of the plated steel strip is polished, comprises:

at least two pairs of side face polishing devices disposed along a traveling direction of the steel strip for polishing the opposite side faces of the steel strip by a pair of rotary brushes which engage with the opposite side faces in a widthwise direction the side face polishing device including a pair of units having the same construction, the unit including a brush support table which directs the rotary brush to the widthwise direction of the steel strip and a base table which supports the brush support table slidably to the widthwise direction;

rail covers slidably stacked on one after another, the covers being moved together with the brush support table;

a washing water spray unit disposed below the rotary brush and above the rail covers;

rotary axes of the rotary brushes of said devices opposed in the widthwise direction of the steel strip being inclined in the same direction relative to the traveling direction of the steel strip, one rotary brush on a side face of the steel strip being set to rotate downwardly thereon and the other adjacent rotary brush on the same side as the one brush being set to rotate upwardly thereon in the case of providing more than two pairs of the side face polishing devices;

a detector for detecting a change of a driving load in a motor which drives the rotary brush; and a controller for adjusting a position of the rotary brush by applying a control signal to a motor which moves the rotary brush in the widthwise direction of the steel strip in response to the detected signal from the detector.

According to the present invention, the edge faces of the plated steel strip are completely polished because the pressure rolls suppress the warps of the edge portions of the steel strip caused by the rotary forces of the rotary brushes. A pair of side face polishing devices can effect complete polishing theoretically. However, if a pair of side face polishing devices having brushes which rotate in the reverse direction and are inclined in the reverse direction are added, it will be possible to obtain more complete polished edge faces. It is further possible to enhance a working efficiency by utilizing the additional devices as in-line spare units.

Since the rotary brush is formed into the hourglass like configuration and inclined with respect to the side face of the steel strip, the brush can contact with the side face over the whole length of the brush.

When the brush wears due to use over a long period of time, a relative position between an outer periphery of the brush and the pressure roll is corrected to always maintain the pressure roll at a suitable position.

Further, according to the present invention, the upward ramp path and downward ramp path are formed in a part of the pass line of the plated steel strip. These ramp paths generate imbalance of a tension distribution in the widthwise direction of the strip. This imbalance becomes maximum in a span between the paths. Consequently, the opposite edge portions of the strip deflect downwardly on the downward ramp path while the edge portions deflect upwardly on the upward ramp path. The present invention positively utilizes this deflection or warp, the rotary brush is turned in the direction to cancel the warp. That is, the rotary brush is turned upwardly with respect to the side face of the steel strip since the edge portion deflects downwardly in the downward ramp path. In the case of the upward ramp path, the brush is turned reversely.

Preferably, a slant direction of the rotary axis of the rotary brush is directed reversely relative to the traveling direction of the steel strip so that the rotary direction of the brush is reversed to the traveling direction. This enhances a polishing efficiency.

Although the warps of the edge portions caused by the rotary forces of the rotary brushes are canceled by the warps of the edge portions caused by the ramp paths, excess warps caused by excess rotary forces can be suppressed by the pressure rolls, thereby completely polishing the edge faces.

The warps caused by the rotary forces can be suppressed by the pressure rolls. The rotary brushes are arranged adjacent to each other in the traveling direction of the steel strip. The rotary axes and directions of the rotary brushes are inclined relative to the traveling direction reversely with each other. Accordingly, the plating layers on the side face, and upper and lower edge faces can be polished.

The warp amount of the edge portion can be adjusted by displacing the pressure roll vertically and horizontally relative to the edge portion of the steel strip, thereby adjusting a polishing amount of the plating layer.

Two pairs of side face polishing devices can completely remove the plating layer on the side face of the plated steel strip. The slidable rail covers can move smoothly on the brush support table, since the washing water is ejected on an area on the covers, on which most polished chips fall, to eliminate the chips from the covers.

BRIEF DESCRIPTION OF THE DRAWINGS

FIG. 19A–19L are explanatory views illustrating polishing states of an edge face of a steel strip in each position of the rotary brush shown in FIG. 18;

DETAILED DESCRIPTION OF THE PREFERRED EMBODIMENTS

A first embodiment of the present invention as embodied in the polishing system for opposite edge faces of a plated steel strip will be described, with reference to FIGS. 1 to 8.

Figure 1:
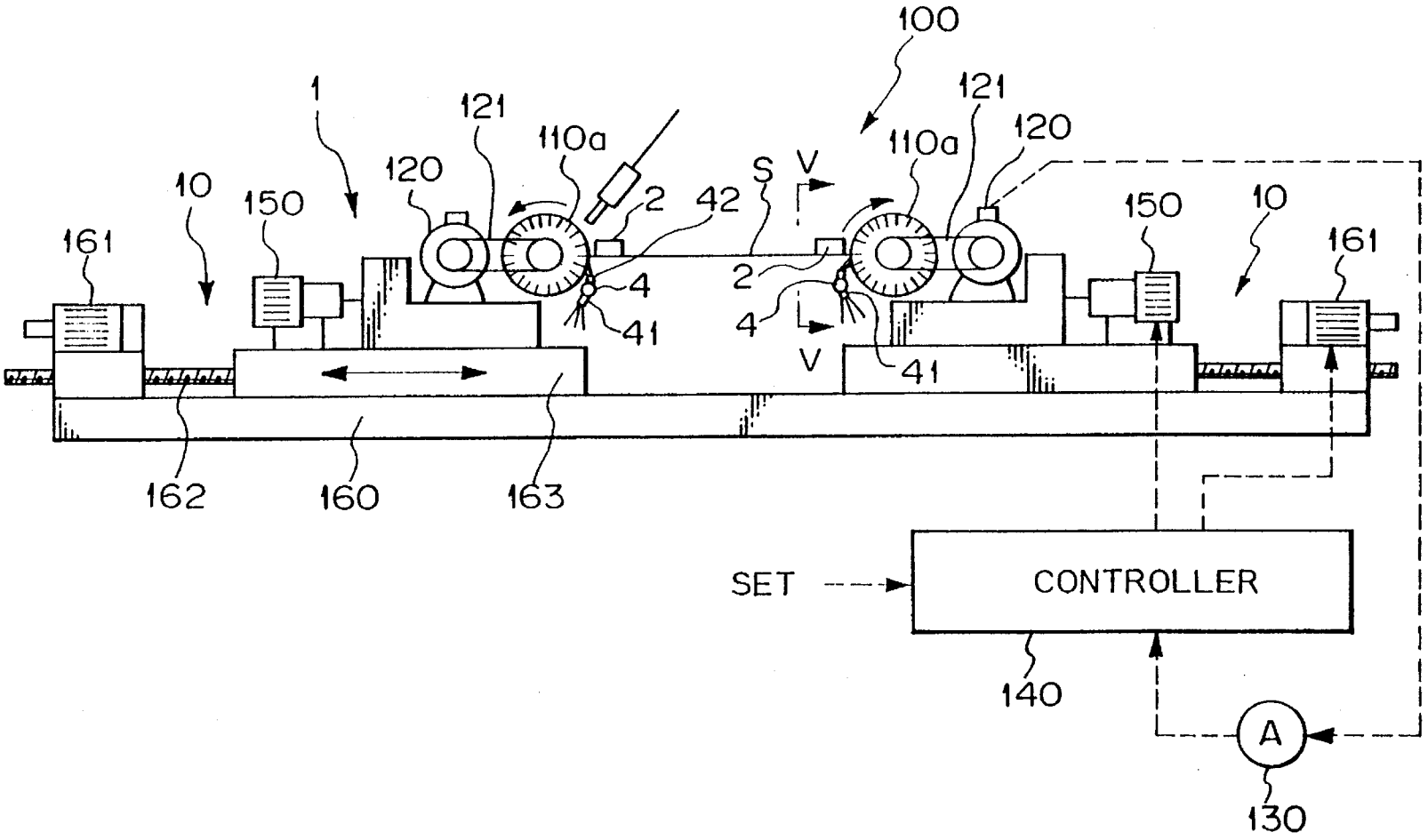
FIG. 1 is a front elevational view of a first embodiment of a polishing system for opposite edge faces of a plated steel strip in accordance with the present invention.
Figure 28:
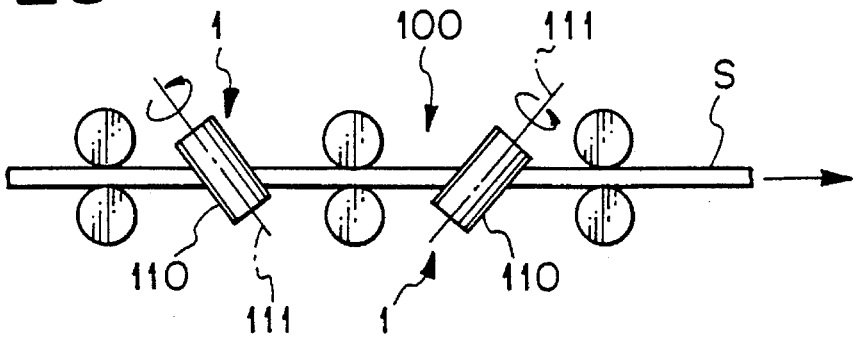
FIG. 28 is a side elevational view similar to FIG. 5, illustrating a conventional polishing system.

Since the present invention relates to an improvement over the previous application of the same applicant entitled as "Polishing System for Opposite Side Faces of the Plated Steel Strip" (Examined Patent Publication No. Hei 5-41385), the general arrangement of the known system will be first described for convenience of description, with reference to FIGS. 1 and 28.

First, the polishing system for opposite edge faces of the plated steel strip is provided on the downstream side of the electroplating system, as shown in FIG. 28. This polishing system for the opposite edge faces of the plated steel strip comprises at least a pair of devices each being adapted to polish opposite side faces of the steel strip in the traveling direction of the steel strip by causing rotary brushes 110 to engage opposite side faces of the steel strip S. The opposite side faces polishing devices 1 are provided by arranging a unit 10 of the same construction in an opposing relationship against each other in the widthwise direction of the steel strip S.

The rotary brushes 110 in each of the devices have their rotary axes arranged in the same direction, but it may be more preferable to arrange these brushes to be inclined alternatively in a reverse direction relative to the traveling direction of the steel strip S, since such inclination of the rotary brushes may serve to ensure a more reliable polishing operation.

To trace the meandering movement of the steel strip S, a detector 30 is used to detect variation in the driving load in the motor 120 which operates to drive the rotary brush 110, as shown in FIG. 1, and such detection signal is sent to a control board 140 and adjust the position of the rotary brush 110 by sending control signals to the motors 150 and 161.

Both units 10 are provided with control systems as above-described, but only a unit 10 is illustrated for convenience of description.

The device 1 is formed from a pair of units each having the same construction. For convenience of description, one of the unit 10 will be described hereinbelow. The side face polishing device 1 has a carriage 163 threadably engaged with a screw rod 162 which is in turn rotated by means of a motor 161 which is attached on a base 160 and is exclusively used for a high-speed operation. The carriage 163 is made to be slidable along the screw rod 162 via a gear train (not shown) by means of a motor 150 used exclusively for medium and low speed operations. That is, the carriage 163 is provided with the medium and low speed operation motor 150, and the shaft of the motor (not shown) is coupled with the screw rod 162 via a gear train (not shown). Thus, when the medium and low speed operation motor 150 is driven to rotate, the gear train (not shown) which is threadably engaged with the screw rod 162 is caused to rotate, and the carriage 163 can move in the fore and aft directions along the screw rod 162 at medium and low speeds depending on the rotating direction and speed of the motor 150.

When the high speed operation motor 161 rotates the screw rod 162, then the carriage 163 which is threadably engaged with the screw rod 162 is caused to move in the fore and aft directions along the screw rod 162 at a high speed, depending on the rotating direction and the speed of the motor 161.

The carriage 163 is provided at its tip end with rotary brushes 110 and a motor 120 for rotating the rotary brushes 110. A reference numeral 121 represents a drive belt. A reference alphabet S represents a plated steel strip which is indicated as a material to be polished. As shown in FIG. 28, the rotary brushes 110 retract toward the widthwise direction of the plate together with the carriage 163 while allowing its central portion continuously to be in contact with the side face of the plated steel strip. The rotary brushes may constantly maintain their brushing pressure P depending on variation in the steel strip width and the positional displacement of the side face.

The device 1 may accommodate itself to variation in the steel strip width and the possible shift of the edge face on the steel strip utilizing as a control input variation in the electric currency which is caused by variation in the load in the brush driving motor 120.

Although the brushes 110 may be made to retract in the widthwise direction of the plated steel strip at a constant speed, while keeping itself in contact with the side face on the plated steel strip S, the brushes can alternatively be designed such that the greater the displacing of the side face the faster the brushes move, and thereby a fast response to the shift of the brushes is ensured. In such a case, the speed may be made continuously variable, but approximately a three-step speed may be sufficient for the needs of a practical application.

Any variation in the above-described position and the speed can be accomplished by controlling alternative actuation of the high speed operation motor 161 and the medium and low speed operation motor 150, their normal/reverse rotation and their rotary speeds. The above-described operation permits the brushes to polish the side face while keeping a distance between the side face and the brushes at a constant and accommodating themselves to variation in the plated steel strip width and positional displacement of the side face of the plated steel strip S.

Figure 30A:
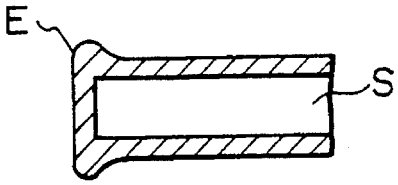
Fig. 30A PRIOR ART
FIGS. 30A to 30C are explanatory views illustrating polishing states of side faces of steel strips by the conventional system.
Figure 30B:
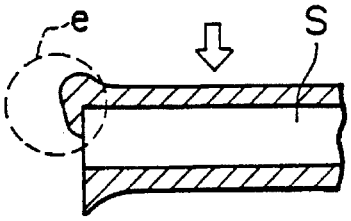
Fig. 30B PRIOR ART

Then, when the rotary brushes 110 are arranged such that their rotary axes 111 may be in parallel with the side face of the one side plated steel strip shown in FIG. 28, while the brushes 110 retract in the widthwise direction of the strip In contact with the side face of the plated steel strip S, the brushes can polish the plated coating off one side face of the plated steel strip (FIG. 30B). This may be sufficient if one wishes to polish the excessive deposit of the plating on the one side plated steel strip, but a satisfactory result may not be expected with the two side plated steel strip, because a portion may not be removed from the end of one side.

Figure 29A:
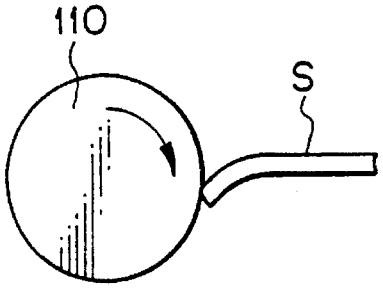
Fig. 29A PRIOR ART
FIGS. 29A and 29B are explanatory views of warps of edge portions of a steel strip in the conventional polishing system.
Figure 29B:
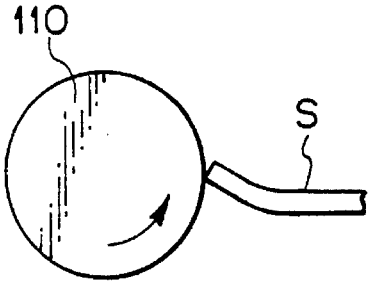
Fig. 29B PRIOR ART
Figure 30C:
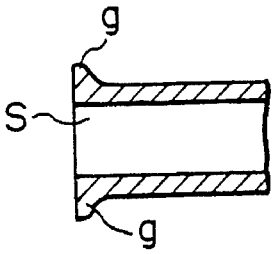
Fig. 30C PRIOR ART

Thus, each of the rotary brushes 110 is designed such that its rotating axis 111 may be made inclinable in a discrete angle relative to each other while allowing them to rotate in an opposing direction to each other. By this arrangement, it is theoretically made possible to polish the plated coating off the edge face of the two side plated steel strip as shown in FIG. 30C. However, as above-described, the steel strip S is caused to warp at its portion adjacent to its opposite edge portions under the rotating forces of the brush, as shown in FIG. 29A or 29B, making it hard to completely remove the excessively plated coating from the edge face.

Figure 2:
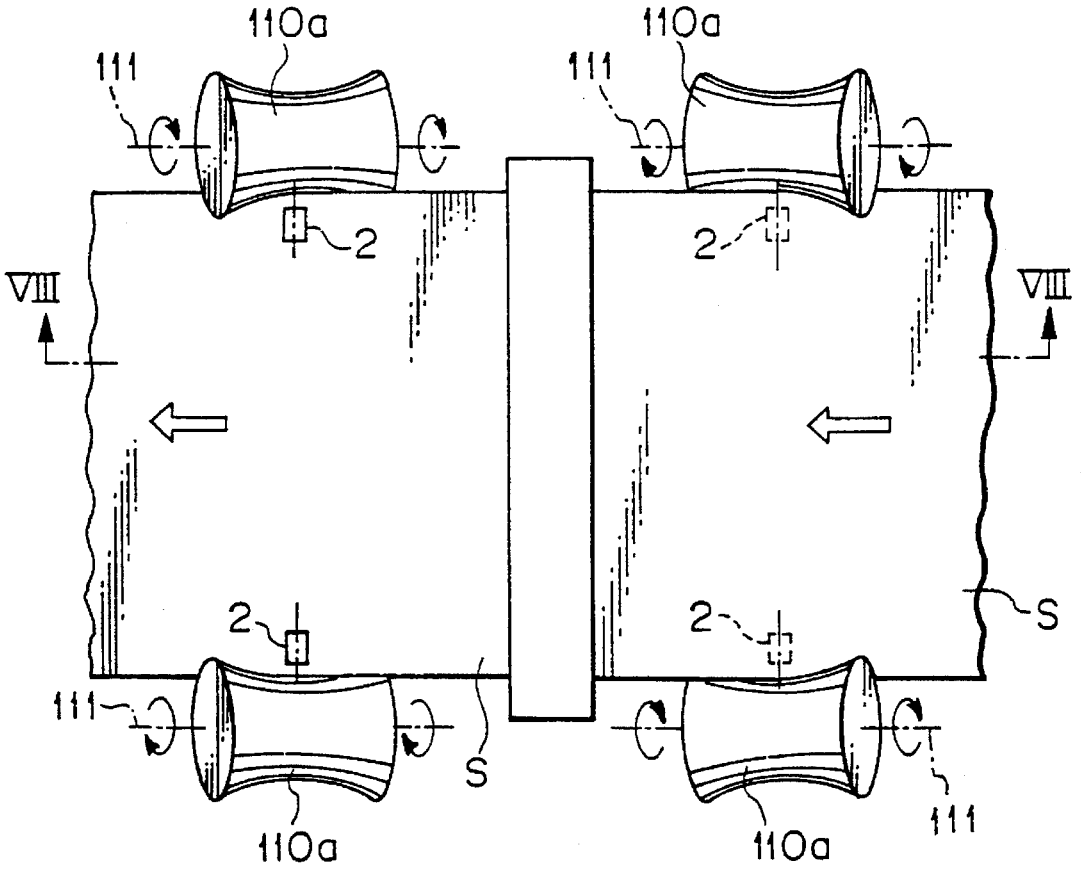
FIG. 2 is plan view of a part of the system shown in FIG. 1
Figure 5A:
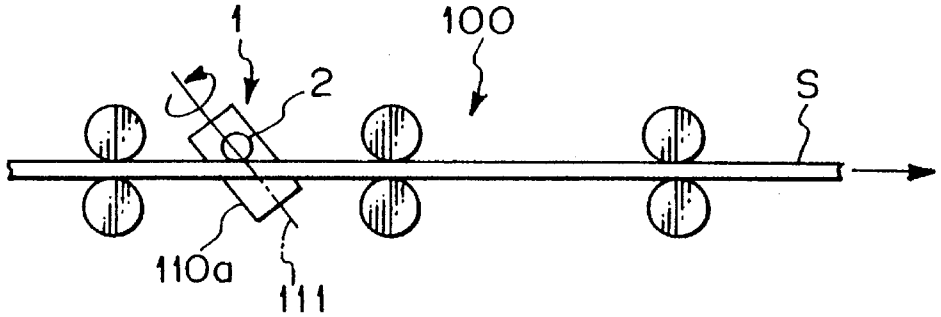
FIGS. 5A to 5C are side elevational views taken along line V—V shown in FIG. 1.
Figure 5B:
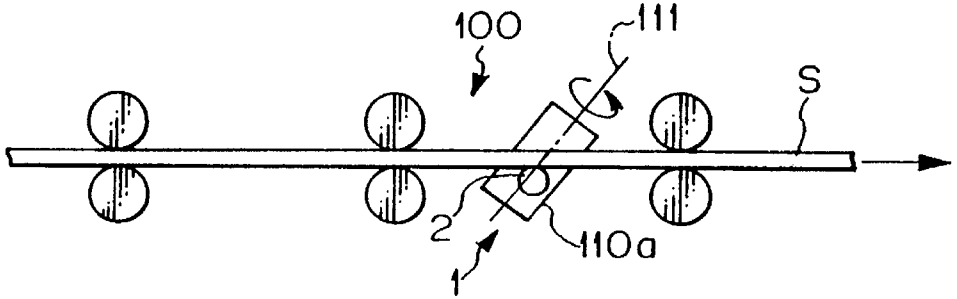
Figure 5C:
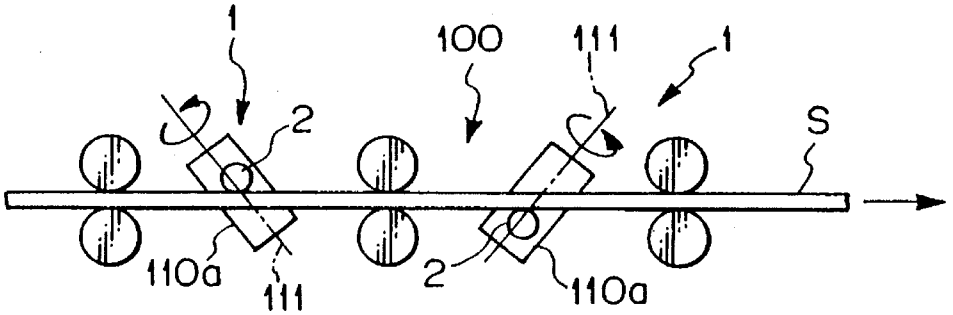

Therefore, in the present invention, at least a pair of side face polishing devices 1 is provided along the traveling direction of the steel strip S as shown in FIGS. 1, 2 and 5. The rotating axes 111 of the rotary brushes, each being arranged to oppose each other in the widthwise direction of the polishing devices 1 are inclined in the same direction relative to the traveling direction of the steel strip S (as shown in FIG. 5A or 5B). When two or more pair of side face polishing devices are provided, the rotary brushes 110*a* which are adjacent to the traveling direction of the steel strip S in the same edge face on the steel strip S are arranged such that one of them may be set to polish the edge face from the upward direction to the downward direction, and the other may polish the face from the downward direction to the upward direction (FIG. 5C).

As above-described, the steel strip is warped at its opposite edge portions under rotating forces of the rotary brush 110. Accordingly, the present invention provides a mechanism for adjusting the warp of the edge portion of the steel strip.

Figure 8:
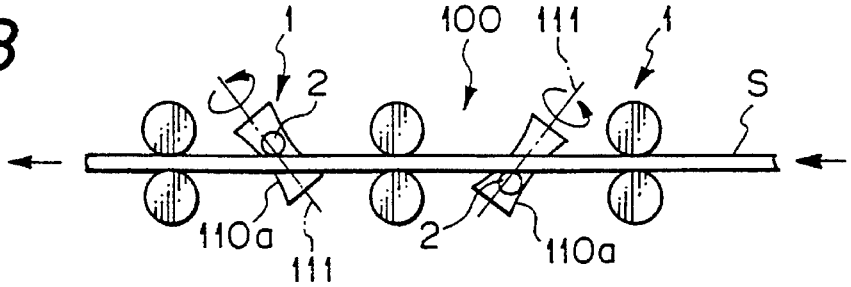
FIG. 8 is a side elevational view taken along lines VIII—VIII in FIG. 2.

As one example of this mechanism, in the present embodiment, a pressure roll 2 is provided on the upper and lower surfaces adjacent to the side face of the steel strip where the rotary brush 110*a* is utilized to polish the side face of the steel strip from the upward direction to the downward direction, as best shown in FIGS. 2 and 8.

In accordance with the present invention, since the pressure roll 2 urges the edge portion of the steel strip from opposite directions to prevent its warp (FIGS. 29A and 29B) which would otherwise occur under the rotating forces of the rotary brushes 110*a*, and thus it becomes available to completely polish the steel strip at its edge faces (FIG. 30C).

A single unit side face polishing device may suffice the need theoretically (FIG. 5A or 5B). However, as shown in FIG. 5C, the surface can be finished in a more perfectly polished condition by further providing an additional brush 110*a* which is inclined for rotation in the reverse direction. This may improve a working efficiency since such an additional rotary brush may be a standby as a replacement brush when a pair of devices 1 are not needed.

In the present invention, the rotary brush is formed in the configuration of hourglass. This hourglass like configuration permits the rotary brush 110*a* to enter into contact with any of its circumferential surface with the side face of the steel strip along the entire length of the brush, as shown in FIGS. 3, 4 and 4A to 4C illustrating the rotary brush 110a which is in contact with the edge face of the steel strip S, when it is at positions A, B and C respectively in FIG. 3.

Furthermore, in the present invention, when the brush 110*a* has worn out after use for extended period of time, it is necessary to correct a relative position between the brush's outer circumference and the pressure roll 2, so that the pressure roll 2 may be constantly maintained at a suitable position.

Therefore, a detector 3 is provided on the brush support carriage 163 for detecting the position of the rotary brush 110*a* and the side face of the steel strip where they are subject to a polishing operation. A mechanism 21 is mounted on the brush carriage 163 for moving the pressure roll 2 in the widthwise direction of the steel strip so that a control signal may be delivered from the pressure roll controller 22 to the pressure roll moving mechanism 21 in response to a signal which has been detected by the polishing position detector 3.

In the pressure roll displacing mechanism 21 may be embodied a typical moving mechanism, and it consists of a support arm 211, a screw rod 212 and a drive motor 213 in the illustrated example. The control signal from the pressure roll controller 22 is inputted to the drive motor 213 to rotate the screw rod 212 for advancing or retracting the support arm 211.

Though not illustrated in FIG. 1, slidably stacked rail covers 164 (FIGS. 26 and 27) is provided on a surface where the base 160 and the brush support carriage 163 may slide over each other to prevent fall or accumulation of polished dust. Contrary to this, the prior art system as above-described is not concerned about the removal of polished dust which would fall and accumulate on the rail covers 164. If such polished dust is not removed, the rail covers may not be moved so easily, resulting in the event where the carriage 163 cannot be moved at all, as described above.

Therefore, in the present invention, a spray header 4 is provided in the area immediately below the rotary brush 110*a*, as shown in FIG. 1, and spray nozzles 41 are provided in position on the spray header 4. High-pressure water is ejected from the spray nozzle 41 to remove any foreign material which would be left on the rail covers. This spray header will be described further in detail hereinbelow.

Each of the hourglass like rotary brushes preferably has a ratio between the maximum diameter D1 and the minimum diameter D2 of 1.02 to 1.30, and a ratio between the length 1 of the brush 110*a* and the minimum diameter D2 (1/D2) of 0.66–0.72. Each of the rotary brushes preferably has its rotary axis 111 inclined at an angle of 15°–50°.

The pressure roll 2 should be located such that the roll has its end surface laid at a position about 0–25 mm inside from the edge face of the steel strip, approximately ±0–±1 mm from the pass line of the steel strip, where + is an urging direction and–is a peel off direction.

The systems of the present invention are arranged with two units as one set such that the rottary brush 110*a* may retract in the widthwise direction of the steel strip while it rotates in contact with opposite end faces of the plated steel strip, but it may alternatively be arranged independently at a later stage in the plating line. Moreover, the system of the present invention may also be utilized to polish an edge face for the purpose of removing materials other than excessive plating deposits.

Table 1 indicates results of various materials and dimensions which have been polished by utilizing the system of the present invention.

TABLE 1

| Type of Plating | Dimensions | | Plating Weight ($g/m^2$) | Side Face State | |
|---|---|---|---|---|---|
| | Thickness (mm) | Width (mm) | | Prior Art | Present Invention |
| Pure Zinc Plating | 0.4–1.6 | 650–1800 | 0/10–0/100 (One Side) | ○ | ○ |
| | 0.4–1.6 | 650–1800 | 10/10–100/100 (Two Sides) | X | ○ |
| Zn—Ni Plating | 0.4–1.6 | 650–1800 | 0/10–0/40 (One Side) | Δ | ○ |
| | 0.4–1.6 | 650–1800 | 10/10–40/40 (Two Sides) | X | ○ |
| Zinc-Iron Plating | 0.4–1.6 | 650–1600 | 0/20 (One Side) | Δ | ○ |
| | 0.4–1.6 | 650–1600 | 20/20 (Two Sides) | X | ○ |

○ mark indicates that no plating material has been peeled off.
X mark indicates that some plating materials have been peeled off.
Δ mark indicates that a slightly good condition has been provided.

In accordance with the present embodiment, it is made possible to thoroughly remove the electrically plated coating off opposite edge faces of the two side plated steel strip, and can thus eliminate the need of the edge trimming operation which has been conventionally taken after the electroplating operation. Moreover, since the excessively plated material polishing operation can be performed using at least a pair of side face polishing devices, the other devices may be a standby in preparation for replacement, thus increased operational efficiency may be accomplished. Moreover, the present invention may solve a problem in the quality of the side face, which might be encountered when the plated steel strip is being processed, after it has been made using the system of the present invention.

Figure 9:
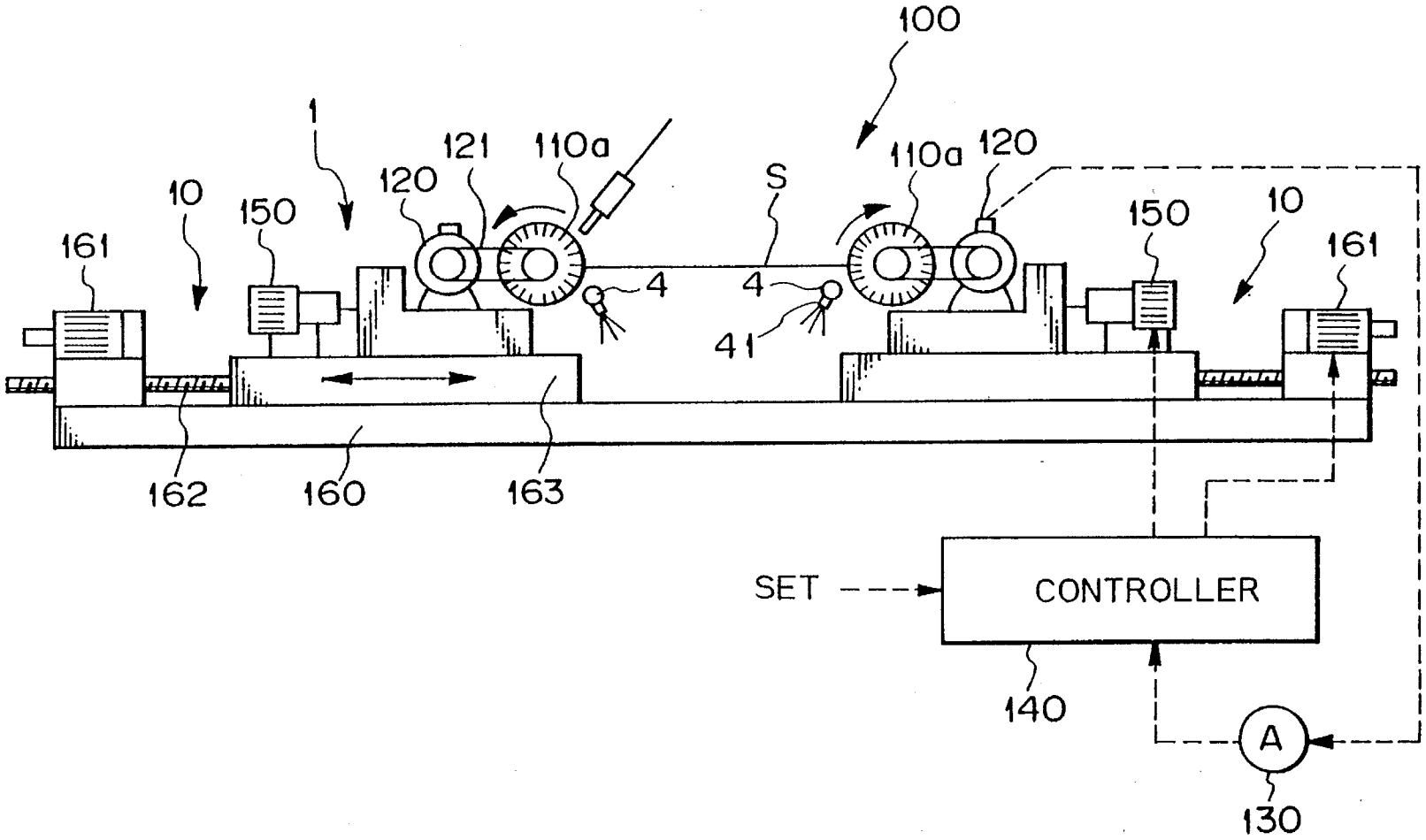
FIG. 9 is a front elevational view of a second embodiment of a polishing system for opposite edge faces of a plated steel strip in accordance with the present invention.

Next, a second embodiment of a polishing system for opposite edge faces of a plated steel strip in accordance with the present invention will be explained below by referring to FIGS. 9 thorough 14.

As described above, the steel strip S is warped at its opposite edge portions by the rotary forces of the rotary brushes 110*a*. Accordingly, the present invention provides a mechanism for adjusting the warps of the opposite edge portions of the steel strip with the polishing system.

An example of the warp adjusting mechanism in this embodiment, as shown In FIGS. 9 through 14 (in particular, FIGS. 10 and 11), forms an upward ramp path PU and a downward ramp path PD In a pass line of a steel strip S passing between the opposite rotary brushes 110*a* by at least three path rolls 7 provided in a given spaced distance in the pass line. The mechanism insulates a tension caused in the ramp paths PU and PD from other paths by wringer rolls 8 provided on inlet and outlet sides of the ramp paths PU and PD.

Figure 12A:
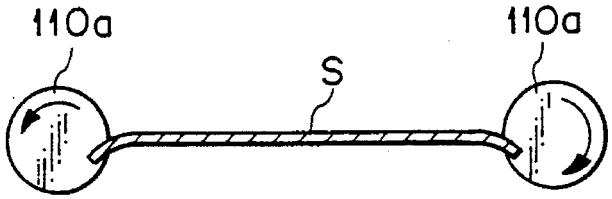
FIGS. 12A to 12C are cross sectional views (A), (B) and (C) in the respective positions a, b and c in FIG. 10.
Figure 12B:
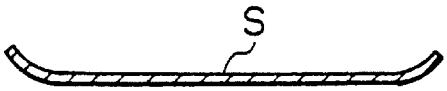

As described above, the steel strip S is warped at its opposite edge portions in the widthwise direction by the ramp paths PU and PD. For example, as shown in FIGS. 10 and 12, the maximum downward warps (FIG. 12A) are generated at a center position a—a on the downward path PD. Contrary to this, the maximum upward warps (FIG. 12B) are generated at a center position b—b on the upward path PU.

Thus, the rotary direction of the rotary brush 110*a* is determined to cancel the above warps of the edge portions.

Preferably, the rotary axis 111 of the rotary brush 110*a* is inclined with respect to the traveling direction of the steel strip S so that the rotary direction of the brush 110*a* is opposed to the traveling direction, in order to enhance a polishing efficiency.

Accordingly, the rotary brush 110*a* is turned downwardly relative to the side face of the steel strip S on the upward ramp path PU while the brush 110*a* is turned upwardly on the downward ramp path PD.

Figure 10A:
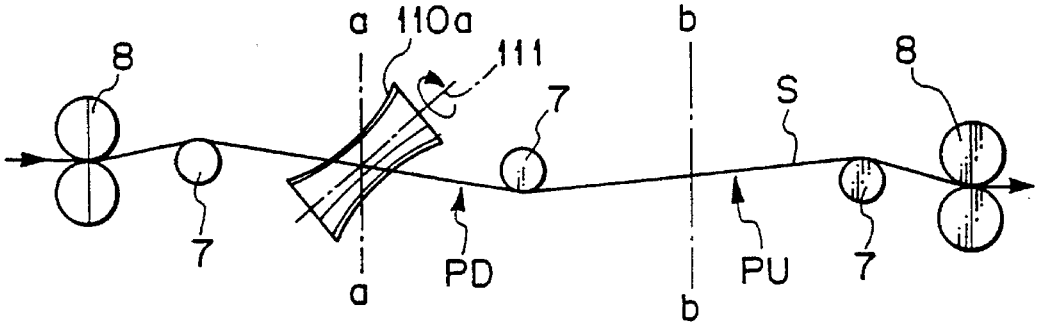
FIGS. 10A to 10C are side elevational views of a part of the system shown in FIG. 9, illustrating various modes of the second embodiment.
Figure 10B:
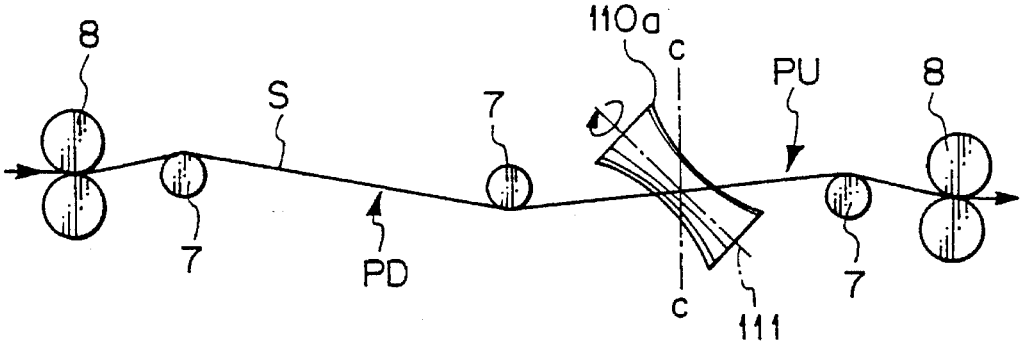
Figure 10C:
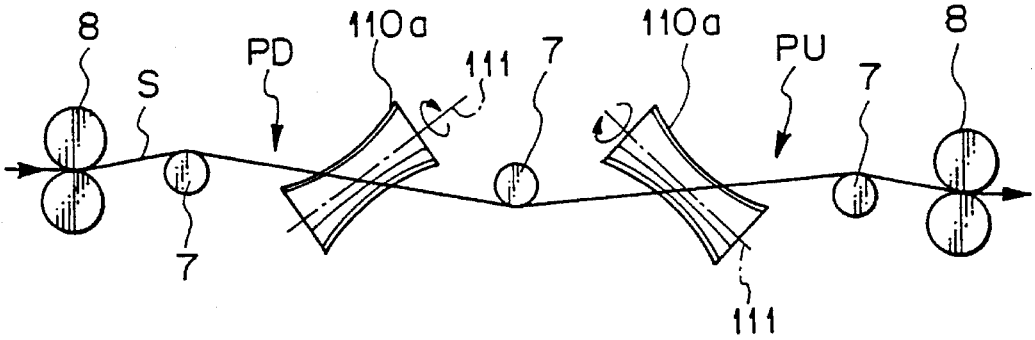

At least one pair of side face polishing devices 1 are disposed along the traveling direction of the steel strip S. The rotary axes 111 of the rotary brushes 110*a* which are opposed to each other in the widthwise direction of the steel strip S in each device 1 are inclined in the same direction relative to the traveling direction of the steel strip S (see FIG. 10A or 10B and FIG. 12A or 12C). In the case of the provision of more than two pairs of the side face polishing devices 1, one rotary brush 110*a* on a side face of the steel strip S is set to rotate downwardly thereon and the other adjacent rotary brush 110*a* on the same side as the brush 110*a* is set to rotate upwardly thereon (FIG. 10C).

Figure 11A:
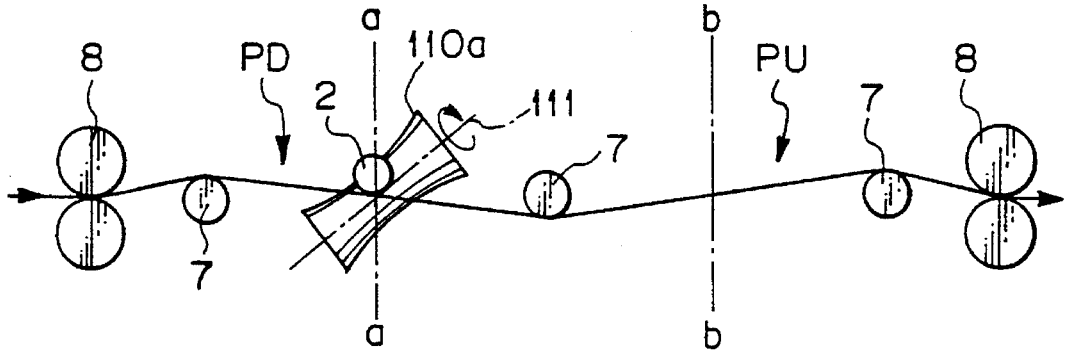
FIGS. 11A to 11C are side elevational views of a part of the system shown in FIG. 9, illustrating various modes of another embodiment.
Figure 11B:
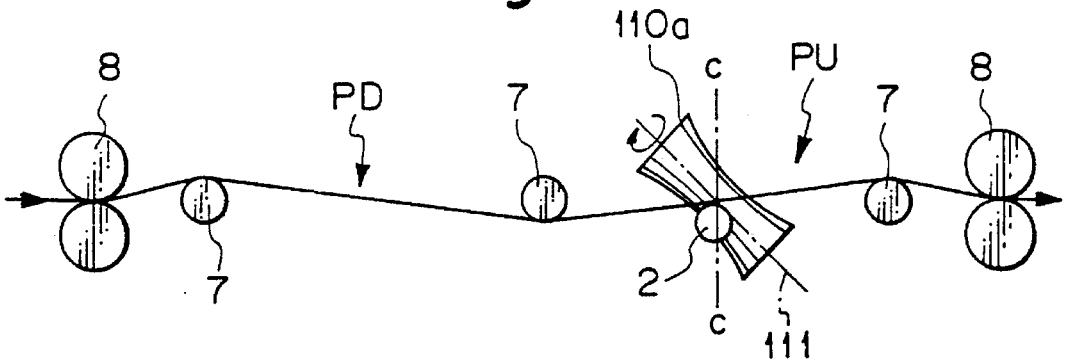
Figure 11C:
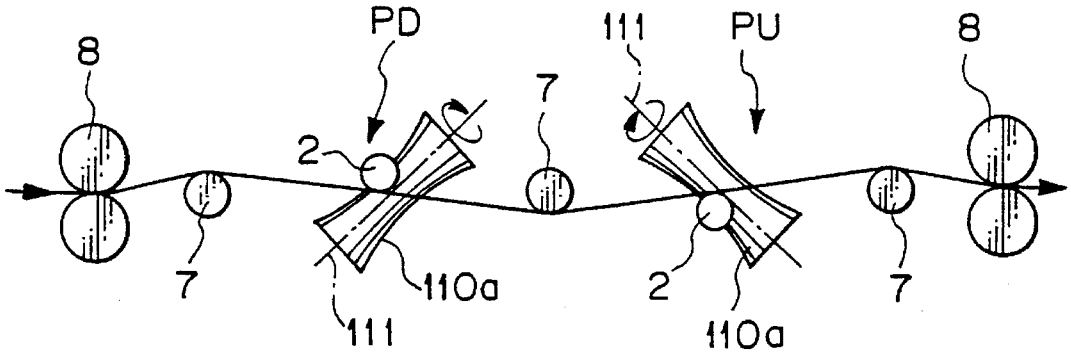
Figure 13A:
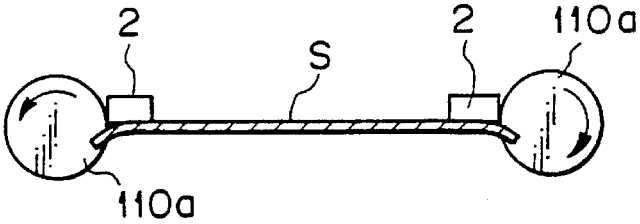
FIGS. 13A to 13C are cross sectional views (A), (B) and (C) in the respective positions a, b and c in FIG. 11.
Figure 13B:
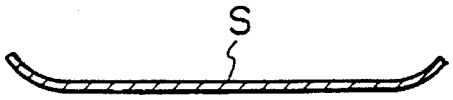
Figure 13C:
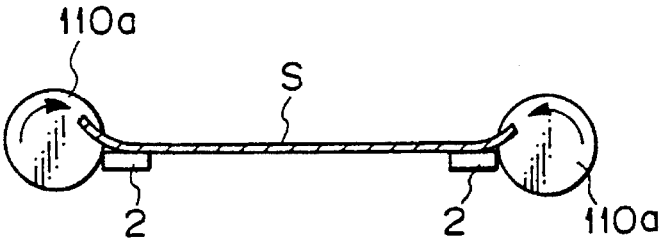
Figure 14:
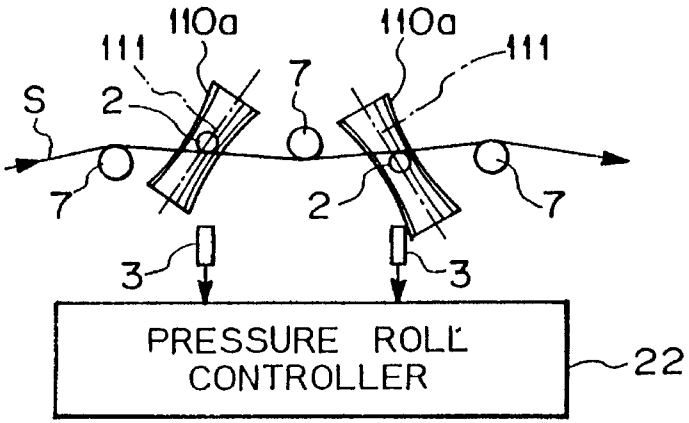
FIG. 14 is a side elevational view similar to FIG. 7.
Figure 15:
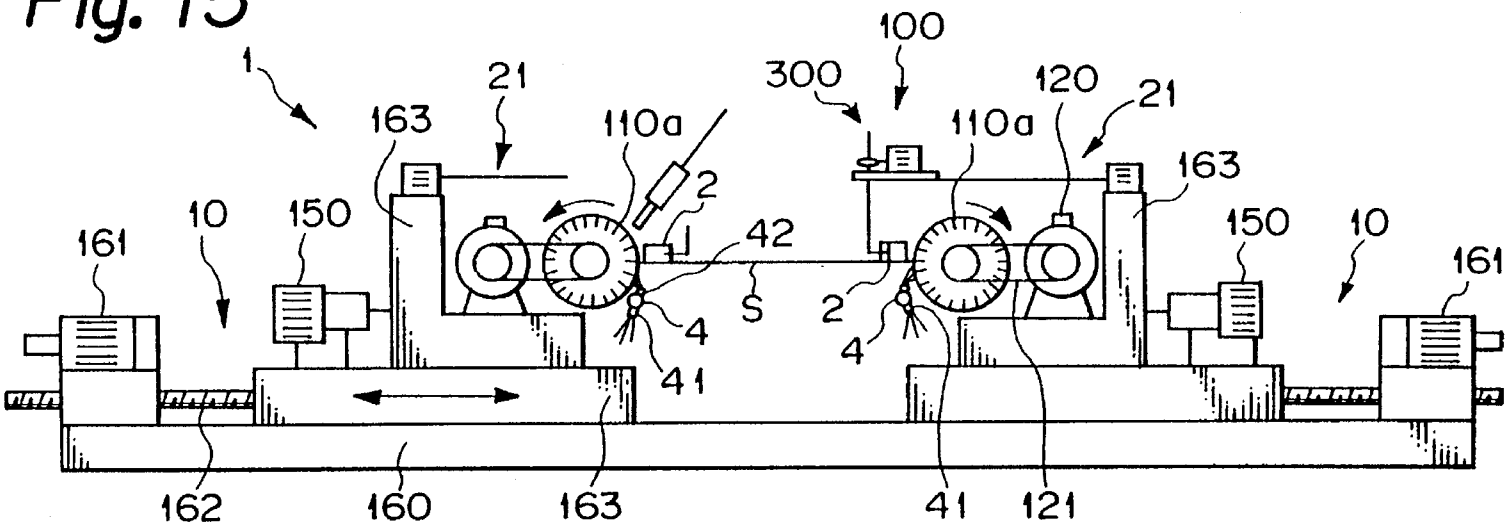
FIG. 15 is a front elevational view of a third embodiment of a polishing system for opposite edge faces of a plated steel strip in accordance with the present invention.

In the case that the rotary force of the rotary brush exceeds a given value, it is necessary to prevent a reverse warp or an excess warp. Thus, as shown in FIGS. 11 and 13, if the rotary brush 110*a* polishes the side face of the steel strip downwardly or upwardly, the pressure roll is disposed on the lower edge face or the upper edge face on the edge portion of the strip. FIGS. 11A, 11B and 11C; and 13A, 13B and 13C correspond to FIGS. 10A, 10B and 10C; and 12A, 12B and 12C, respectively.

According to the present invention, since the pressure roll 2 urges the edge portion of the steel strip from opposite directions to prevent its warping (FIGS. 29A and 29B) which would otherwise occur under rotating forces of the rotary brushes 110*a*, it thus becomes available to completely polish the steel strip at its edge faces (FIG. 30C).

Figure 12C:
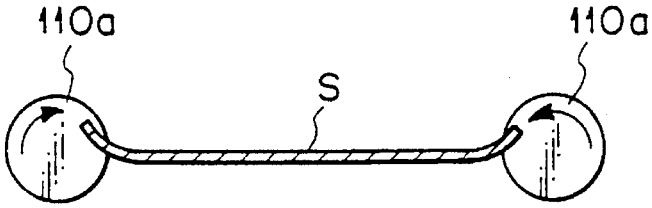

A single pair of edge face polishing devices may be sufficient for the theoretical need (FIGS. 10 and 12A, or 12B). However, as shown In FIGS. 10 or 12C, the surface is finished in a more perfectly polished condition by further providing an additional brush 110*a* which is inclined for rotation in the reverse direction. This may improve a working efficiency since such additional rotary brush may be a standby as a replacement brush when a pair of devices i are not needed.

Figure 3:
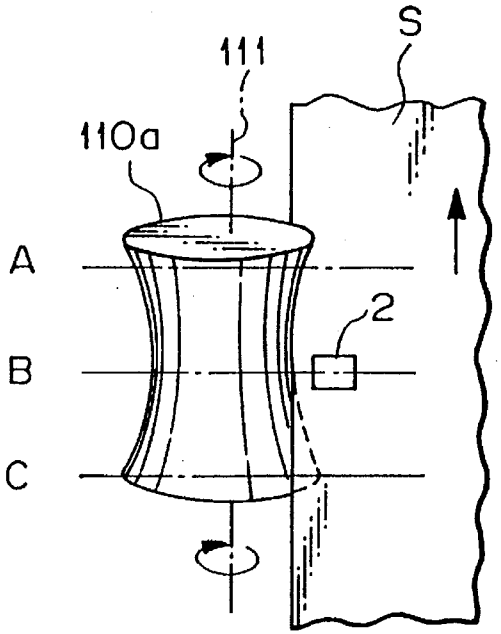
FIG. 3 is an enlarged plan view of a part of FIG. 2.
Figure 4A:
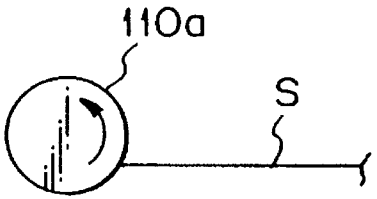
FIGS. 4A to 4C are cross sectional views in each position shown in FIG. 3.
Figure 4B:
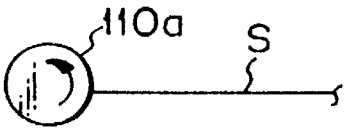
Figure 4C:
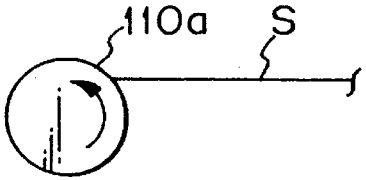

In the present invention, the rotary brush is formed in the configuration of an hourglass. This hourglass configuration permits the rotary brush 110*a* to enter into contact at any part of its circumferential surface with the edge face of the steel strip along the entire length of the brush, as shown in FIGS. 3.4 and 4A to 4C illustrate the rotary brush 110*a* which is in contact with the edge face of the steel strip S, when it is at positions A, B and C respectively in FIG. 3.

Furthermore, in the present invention, when the brush 110 has been worn out after use for extended period of time, it is necessary to correct a relative position between the brush outer circumference and the pressure roll 2, so that the pressure roll 2 may be constantly maintained at a suitable position.

Therefore, a detector 3 is provided on the brush support carriage 163 for detecting the position of the rotary brush 110*a* and the edge-face of the steel strip where they are subject to a polishing operation. A mechanism 21 is mounted on the brush carriage 163 for moving the pressure roll 2 in the widthwise direction of the steel strip so that a control signal may be delivered from the pressure roll controller 22 to the pressure roll displacing mechanism 21 in response to a signal which has been detected by the polishing position detector 3.

Since the construction of this embodiment is the same as that of the first embodiment shown in FIGS. 1 to 8, its explanation will be omitted below.

Therefore, in the present invention, the spray header 4 is provided in the area immediately below the rotary brush 110*a*, as shown in FIG. 1, and spray nozzles 41 are provided in position on the spray header 4. High-pressure water is ejected from the spray nozzle 41 to remove any foreign material which would be left on the rail covers. This spray header will be further described hereinbelow.

Each of the hourglass like rotary brushes preferably has a ratio between the maximum diameter D1 and the minimum diameter D2 of 1.02 to 1.30, and a ratio between the length 1 of the brush 110*a* and the minimum diameter D2 (1/D2) of 0.66–0.72. Each of the rotary brushes preferably has its rotary axis 111 inclined in the angle off 15°–5°.

The pressure roll 2 should be located such that the roll has its end surface laid at a position about 0–25 mm inside from the edge face of the steel strip, and approximately ±0–±1 mm from the pass line of the strip, where + is an urging direction and–is a peel off direction.

The system of the present invention is arranged with two units where one is set such that the rotary brush 110*a* may retract in the widthwise direction of the steel strip while it rotates in contact with opposite end faces of the plated steel strip, but it may alternatively be arranged independently at a later stage in the plating line. Moreover, it is also available to utilize the system of the present invention to polish an edge face for the purpose of removing materials other than excessive plating deposits.

Table 2 indicates results of various materials and dimensions which have been polished utilizing the system of the present invention.

TABLE 2

| | Dimensions | | | Side Face State | |
|---|---|---|---|---|---|
| Type of Plating | Thickness (mm) | Width (mm) | Plating Weight (g/m²) | Prior Art | Present Invention |
| Pure Zinc Plating | 0.4–1.6 | 650–1600 | 0/10–0/100 (One Side) | O | O |
| | 0.4–1.6 | 650–1600 | 10/10–100/100 (Two Sides) | X | O |
| Zn—Ni Plating | 0.4–1.6 | 650–1800 | 0/10–0/40 (One Side) | Δ | O |
| | 0.4–1.6 | 650–1800 | 10/10–40/40 (Two Sides) | X | O |
| Zinc-Iron Plating | 0.4–1.6 | 650–1600 | 0/20 (One Side) | Δ | O |
| | 0.4–1.6 | 650–1600 | 20/20 (Two Sides) | X | O |

O mark indicates that no plating material has been peeled off.
X mark indicates that some plating materials have been peeled off.
Δ mark indicates that a slightly good condition has been provided.

In accordance with the present embodiment, it is made possible to thoroughly remove the electrically plated coating from opposite edge faces of the two side plated steel strip, and can thus eliminate the need of the edge trimming operation which has been conventionally used after the electroplating operation. Moreover, since the excessively plated material polishing operation can be performed using at least a pair of side face polishing device, and other device may be a standby in preparation for replacement, thus an increased operational efficiency may be accomplished. Moreover, the present invention may solve a problem in the quality of the edge faces, which might be encountered when the plated steel strip is being processed, after it has been made using the system of the present invention.

A third embodiment of a polishing system for opposite edge faces of a plated steel strip in accordance with the present invention will be explained below by referring to FIGS. 15 through 23.

Excess plating portions g (FIG. 30C) still remain on the upper and lower edge faces of the steel strip even by the first and second embodiments.

A mechanism for adjusting warps of the edge portions of the steel strip in the third embodiment positively utilizes the warps of the edge portions of the steel strip caused by the rotary forces of the rotary brushes 110*a* to remove the excess plating portions g, to smooth the plating layers and to completely remove the plating layers on the side faces.

A characterized part of the third embodiment of the polishing system will be explained below while the part described above will not be explained again.

As shown in FIGS. 15 through 18, in the system of the present invention, at least two pairs of side face polishing devices 1 are disposed along a traveling direction of the steel strip S for polishing opposite side faces of the steel strip S by a pair of hourglass like rotary brushes 110*a* which engage with the opposite side faces in a widthwise direction. Rotary axes 111 the hourglass like brushes 110*a* of the devices 1 opposed in the widthwise direction of the steel strip are inclined in the same direction relative to the traveling direction of the steel strip. Rotary axes 111 of the hourglass like rotary brushes 110a adjacent to each other on the same side face of the steel strip are inclined in the reverse directions to each other.

Figure 17:
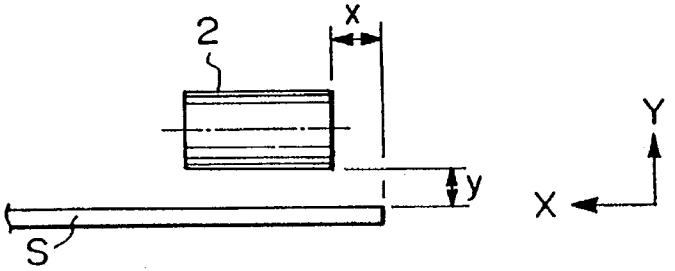
FIG. 17 is explanatory view illustrating a relationship between a pressure roll and an edge of a steel strip.

An hourglass like rotary brush 110*a* on a side face of the steel strip is set to rotate downwardly thereon and the other adjacent hourglass like rotary brush on the same side as the one brush is set to rotate upwardly thereon. A pressure roll 2 disposed on a lower or upper edge face of the steel strip S when the rotary brush 110*a* polishes the side face of the steel strip S downwardly or upwardly. As shown in FIG. 17, a first pressure roll displacing mechanism 300 displaces the pressure roll 2 in a direction perpendicular to a surface of the steel strip.

The first pressure roll displacing mechanism 300 comprises a conventional gear train or link mechanism and a conventional motor or a hydraulic cylinder.

A second pressure displacing mechanism 21 may be any conventional displacing mechanism. For example, the mechanism shown in the drawings comprises a support arm 211, a screw rod 212, and a drive motor 213. A control signal from a pressure roll controller 22 is applied to the drive motor 213 to rotate the screw rod 212, thereby moving the support arm 211 forwardly or backwardly.

Furthermore, in the present invention, when the brush 110*a* has been worn out after use over extended period of time, it is necessary to correct a relative position between the brush outer circumference and the pressure roll 2, so that the pressure roll 2 may be constantly maintained at a suitable position.

Therefore, a detector 3 is provided on the brush support carriage 163 for detecting a position of the rotary brush 110*a* and the edge face of the steel strip where they are subject to a polishing operation. A mechanism 21 is mounted on the brush carriage 163 for moving the pressure roll 2 in the widthwise direction of the steel strip so that a control signal may be delivered from the pressure roll controller 22 to the pressure roll displacing mechanism 21 in response to a signal which has been detected by the polishing position detector 3.

Figure 16:
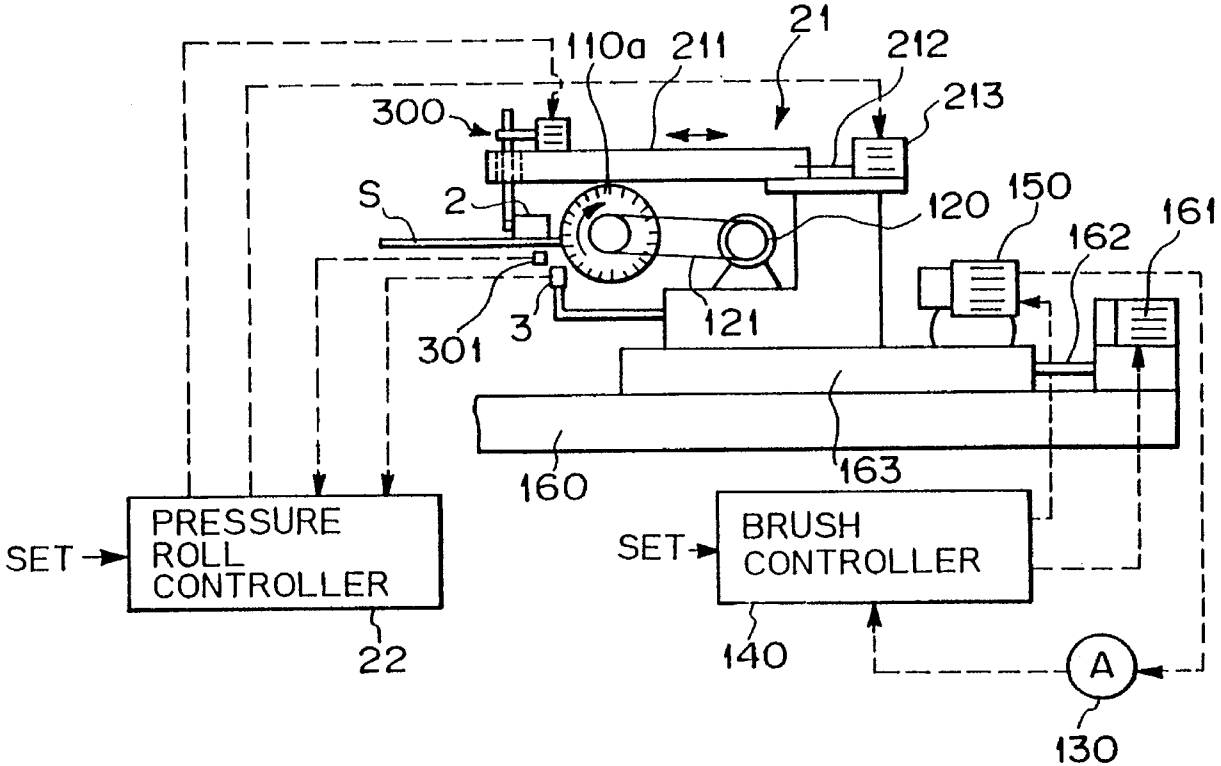
FIG. 16 is an enlarged front view of a part of FIG. 15.

On the other hand, as shown in FIG. 16 a detector 301 which measures a distance from the edge portion of the steel strip S (warp) is mounted on a base table 160. A detecting signal from the detector 301 is applied to the pressure roll controller 22. The first pressure roll displacing mechanism 300 is controlled in accordance with a control signal from the controller 22.

In the present invention, the rotary brush is formed in the configuration of an hourglass.

Figure 20:
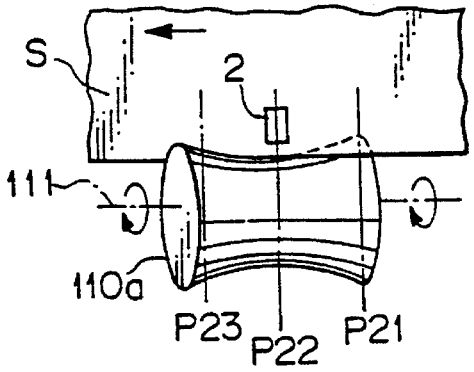
FIG. 20 is an explanatory view illustrating each representative position on a rotary brush on a downstream side in FIG. 18.
Figure 21A:
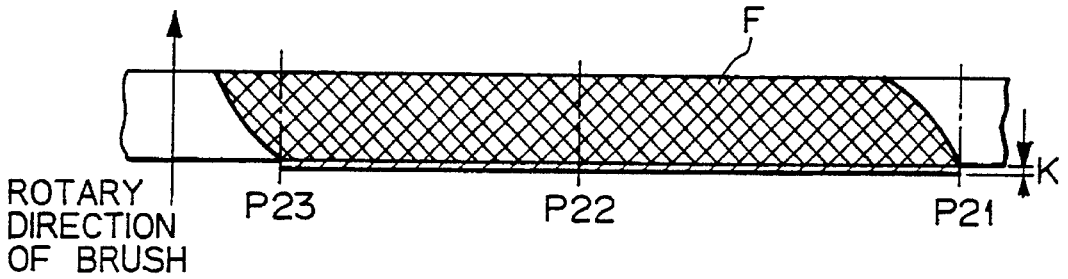
FIGS. 21A and 21B are side elevational views illustrating contacting faces between the rotary brush and the side face of a steel strip in FIG. 20 in the case of causing warps of the steel strip (A) and causing no warps of the steel strip (B)

This hourglass like configuration permits the rotary brush 110a to enter into contact at any part of its circumferential surface with the edge face of the steel strip along the entire length of the brush, as shown in FIGS. 20 and 21A.

Figure 21B:
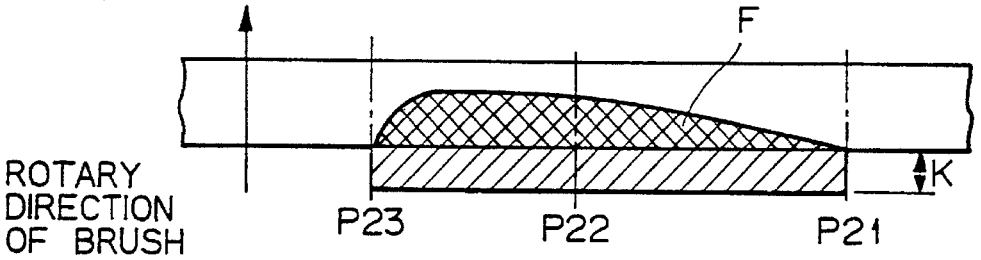

Representative positions on the hourglass like rotary brush 110*a* in FIG. 20, that is, a right end P21, a center P22 and a left end P23 correspond to P21, P22 and P23 in FIGS. 21 and 22, respectively. FIG. 21A shows a theoretical brush contacting face F (cross-hatched area) in the case where the edge portions are not warped. A brush wraparound polishing width (the width which the brush polishes the edge face of the steel strip over the side face) K is about 1–3 mm. FIG. 21B shows a state of the steel strip warped by the rotary force of the brush. The width K in this case is about 5–30 mm.

Figure 22A:
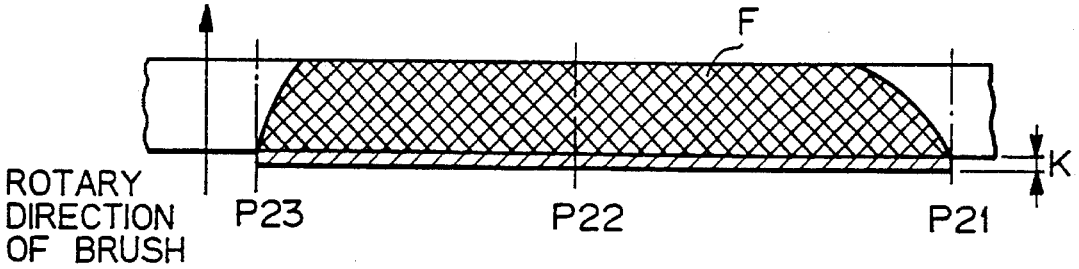
FIGS. 22A and 22B are side elevational views illustrating contacting faces between the rotary brush and the side face of the steel strip in FIG. 20 in the case of decreasing the warps of the steel strip by a pressure roll (A) and in the case of displacing the pressure roll upwardly (B)
Figure 22B:
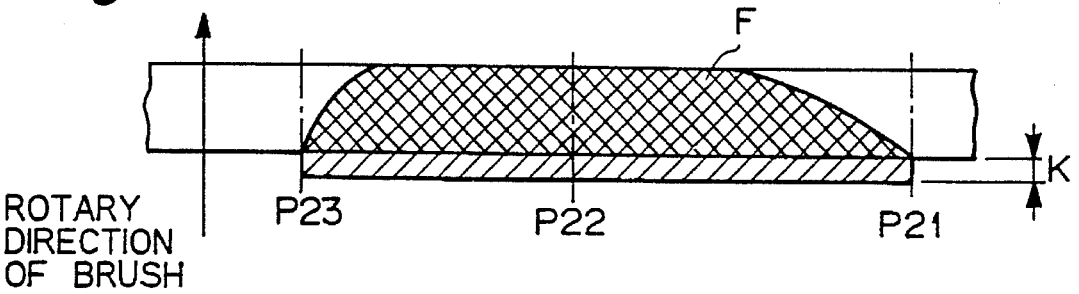

FIG. 22A shows that the warps are reduced by the pressure rolls. In this case, K is about 1–3 mm. FIG. 22B shows that the pressure rolls are moved slightly upwardly in a direction Y perpendicular to the steel strip face (FIG. 17). In this case, K is about 10 mm.

Figure 31:
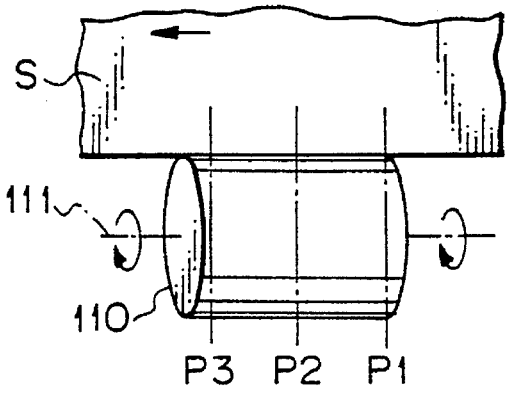
Fig. 31 PRIOR ART
FIG. 31 is a plan view illustrating a relationship of a contacting position between a conventional cylindrical rotary brush and a steel strip.
Figure 32:
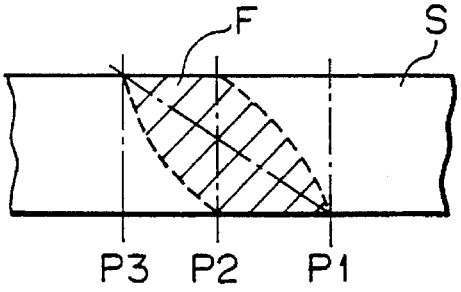
Fig. 32 PRIOR ART
FIG. 32 is a side elevational view illustrating a contacting face, between the rotary brush shown in FIG. 31 and a side face of a steel strip.
Figure 33:
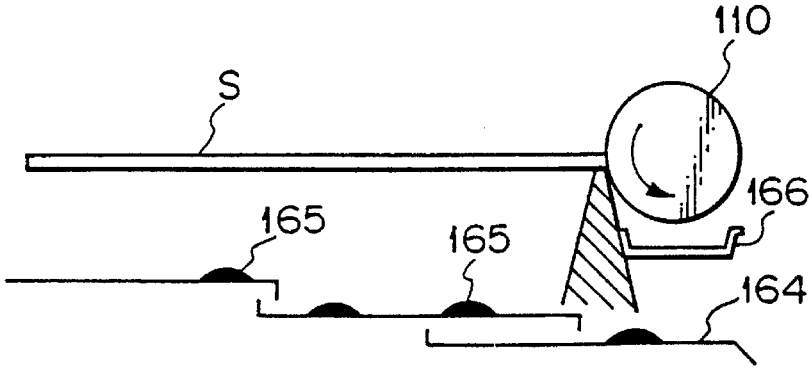
Fig. 33 PRIOR ART
FIG. 33 is a front elevational view of a conventional washing water spray unit.

On the other hand, in the case where a conventional cylindrical rotary brush 110 is simply inclined with respect to the side face of the steel strip as shown in FIG. 31, a brush contacting face F as shown in FIG. 32 can be obtained. In this case, a theoretical contacting face having no warp of the steel strip is shown.

The above explanations illustrate a change of the brush contacting face depending upon different configurations of the rotary brushes visually and under exaggeration. However, FIG. 23 shows a change of polishing width depending upon a change of position of the pressure roll in a quantitative respect.

Figure 23A:
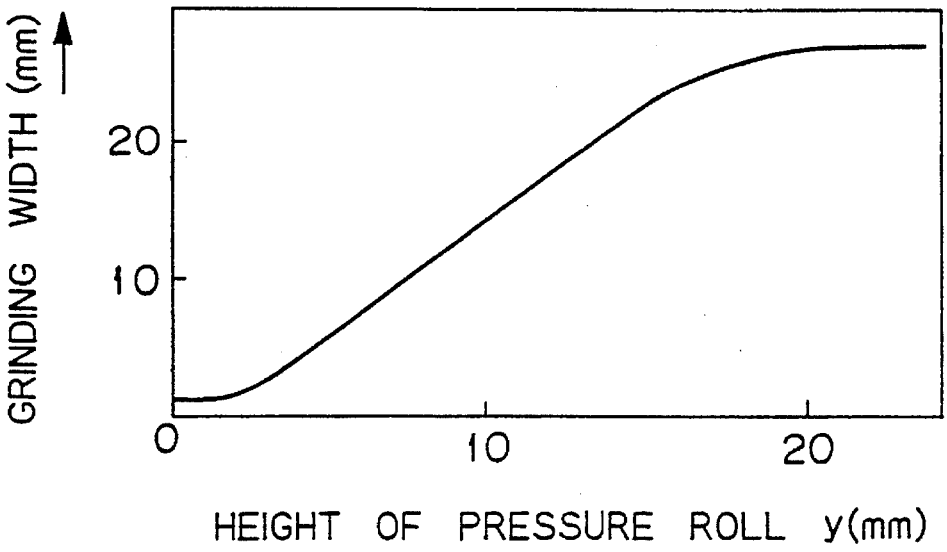
FIGS. 23A and 23B are graphs illustrating relationships between a position of the pressure roll shown in FIG. 17 and a polishing width of a steel strip by a rotary brush.
Figure 23B:
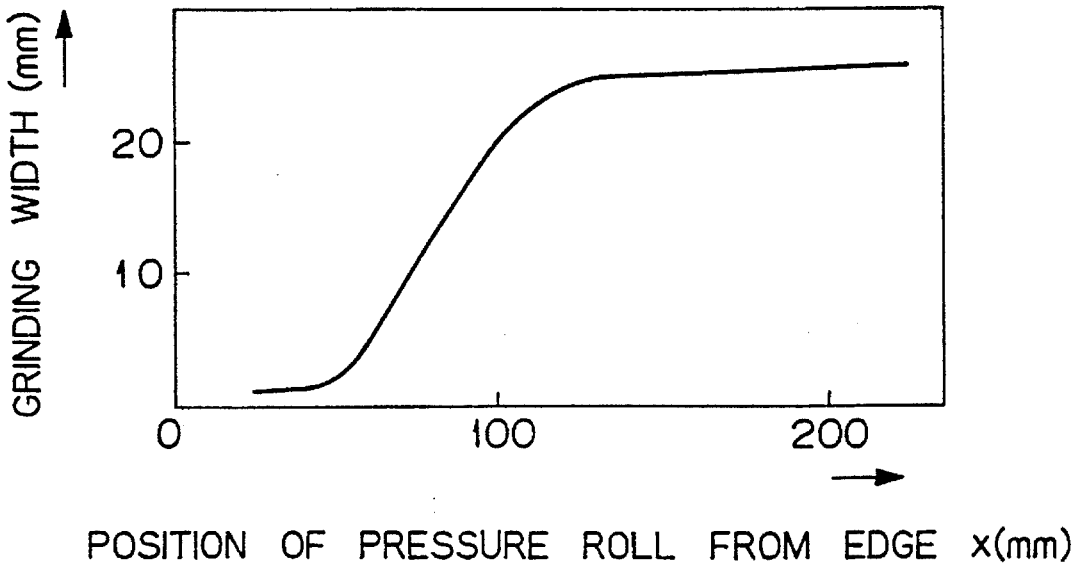

Positions x and y in FIG. 23 correspond to the positions x and y in FIG. 17. A polishing width in FIG. 23 corresponds to the "K" in FIG. 22B.

Thus, the results of polishing the edge faces of a real steel strip in the system of the present invention are shown in FIGS. 18 and 19A–19L.

Figure 18:
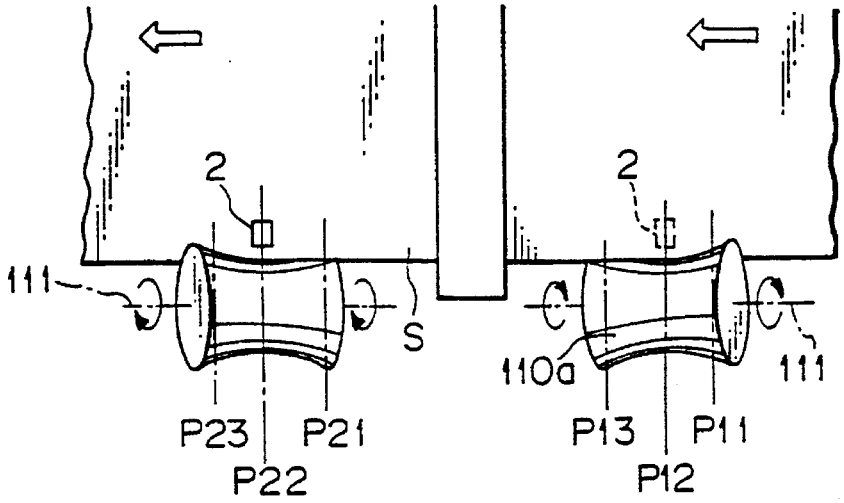
FIG. 18 is a plan view of a part of FIG. 2, illustrating each representative position on a rotary brush.

FIG. 18 is a plan view illustrating the lower half of FIG. 2. The steel strip S moves from the right side to the left side. The rotary brushes 110*a* at the upstream polish the edge faces of the steel strip downwardly while the rotary brushes 110*a* at the downstream polish the edge faces upwardly.

(A11), (A12) and (A13) in FIGS. 19D, 19H and 19L illustrate contacting states between the brush and the steel strip at the representative positions P11, P12 and P13 on the rotary brush 110*a* at the upstream in FIG. 18, respectively. (B11), (B12) and (B13) in FIGS. 19C, 19G and 19K illustrate polishing states of the plating layers on the steel strip corresponding to (A11), (A12) and (A13) in FIGS. 19D, 19H and 19L.

(A21), (A22) and (A23) in FIGS. 19B, 19F and 19J illustrate contacting states between the brush and the steel strip at the representative positions P21, P22 and P23 on the rotary brush 110*a* at the downstream in FIG. 18, respectively. (B21), (B22) and (B23) in FIGS. 19A, 19E and 19I illustrate polishing states of the plating layers on the steel strip corresponding to (A21), (A22) and (A23) in FIGS. 19B, 19F and 19J.

Thus, in the present embodiment, the warp amount of the edge portion of the steel strip is adjusted by adjusting the positions of the pressure roll 2 in the X and Y directions. The upstream rotary brush 110*a* mainly polishes the upper edge face of the steel strip, which the prior art cannot polish, and the downstream rotary brush 110*a* mainly polishes the lower edge faces of the steel strip, which the prior art cannot polish. Consequently, as shown in (B23) in FIG. 19I, the plating layers on the side face of the steel strip can be completely removed while the upper and lower edge faces are polished to be the same thickness as that of the remaining faces, whereby a smooth plating layer can be obtained.

In the case where the rotary direction of the rotary brush 110*a* is reversed, the rotary axis 111 of the brush 110*a* may be inclined reversely. In this case, the operation described above is exactly reversed.

The position of the pressure roll can be changed by the distance y or x in the direction Y or X or distances x and y in the directions Y and X.

The pressure roll 2 is disposed at a position in a range of x=0–25 mm from the side face of the steel strip to the end face of the roll. When the pass line is 0, "+" is the direction toward the pushing direction, and "–" is the direction toward the escaping direction, it is preferably to set y=±1 mm.

Each of the hourglass like rotary brushes preferably has a ratio between the maximum diameter D1 and the minimum diameter D2 of 1.02 to 1.30, and a ratio between the length 1 of the brush 110*a* and the minimum diameter D2 (1/D2) of 0.66–0.72. Each of the rotary brushes preferably has its rotary axis 111 inclined at the angle of 15°–50°.

The system of the present invention is arranged with two pairs with one pair such that the rotary brush 110*a* may retract in the widthwise direction of the steel strip while it rotates In contact with the opposite end faces of the plated steel strip, but it may alternatively be arranged independently at a later stage in the plating line. Moreover, it is also available to utilize the system of the present invention to polish an edge face for the purpose of removing materials other than excessive plating deposits.

Table 3 indicates results of various materials and dimensions which have been polished utilizing the system of the present invention.

TABLE 3

| Type of Plating | Dimensions | | Plating Weight ($g/m^2$) | Side Face State | |
|---|---|---|---|---|---|
| | Thickness (mm) | Width (mm) | | Prior Art | Present Invention |
| Pure Zinc Plating | 0.4–1.6 | 650–1800 | 0/10–0/100 (One Side) | ○ | ○ |
| | 0.4–1.6 | 650–1800 | 10/10–100/100 (Two Sides) | X | ○ |
| Zn—Ni Plating | 0.4–1.6 | 650–1800 | 0/10–0/100 (One Side) | Δ | ○ |
| | 0.4–1.6 | 650–1800 | 10/10–100/100 (Two Sides) | X | ○ |
| Zinc-Iron Plating | 0.4–1.6 | 650–1600 | 0/10–0/100 (One Side) | Δ | ○ |
| | 0.4–1.6 | 650–1600 | 10/10–100/100 (Two Sides) | X | ○ |

○ mark indicates that no plating material has been peeled off.
X mark indicates that some plating materials have been peeled off.
Δ mark indicates that a slightly good condition has been provided.

According to this embodiment, it is possible to completely remove plating layers on the opposite side faces of the steel strip and to remove excess plating layers on the upper and lower edge faces of the strip which the prior art cannot polish, thereby obtaining smooth plating layers. The present embodiment can thus eliminate the need for an edge trimming operation which has been conventionally used after the electroplating operation. Moreover, since the excessively plated material polishing operation can be performed using at least a pair of side face polishing devices, and other devices may be a standby in preparation for replacement, thus an Increased operational efficiency may be accomplished. Moreover, the present invention may solve a problem in the quality of the edge face, which might be encountered when the plated steel strip is being processed, after it has been made using the system of the present invention.

An embodiment of a device for removing polished chips to be used in the first to third embodiments of the polishing system for opposite edge faces of the steel strip in accordance with the present invention will be explained below by referring to FIGS. 24 through 27.

Figure 24:
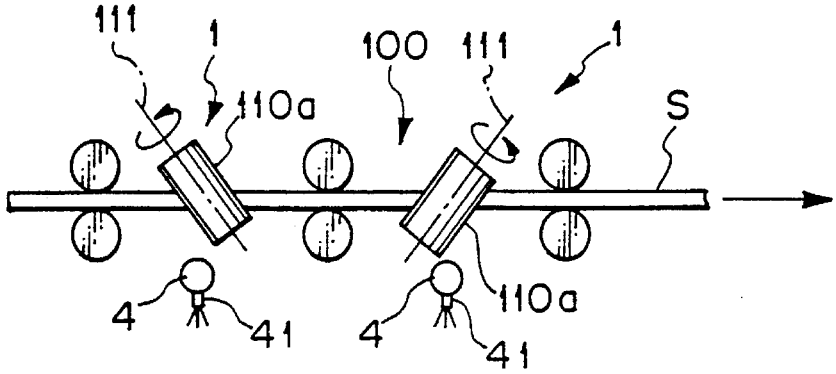
FIG. 24 is a side elevational view of a part of the system shown FIG. 1.
Figure 25:
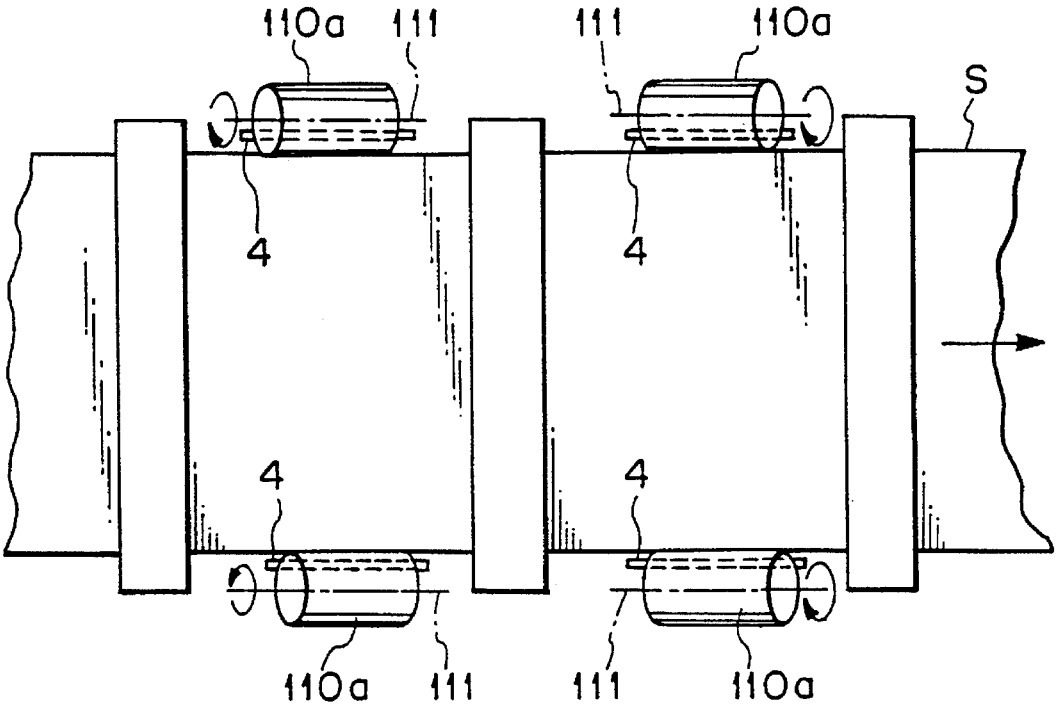
FIG. 25 is a plan view of FIG. 24.

Though not shown in FIG. 24, the rail covers 164 (FIGS. 26 and 27) are provided upon a surface where the base 160 and the brush support table or carriage 163 may slide relative to each other so as to prevent the polishing dusts from falling and accumulating, the rail covers 164 being able to move together with the carriage 163 in a partially stacked manner. However, the known system as above-described is not concerned about removal of polishing dust which may fall and accumulate upon the rail covers 164. If such polishing dust is not removed, it may become hard to move the rail covers and eventually the carriage 163 cannot be moved.

Figure 26:
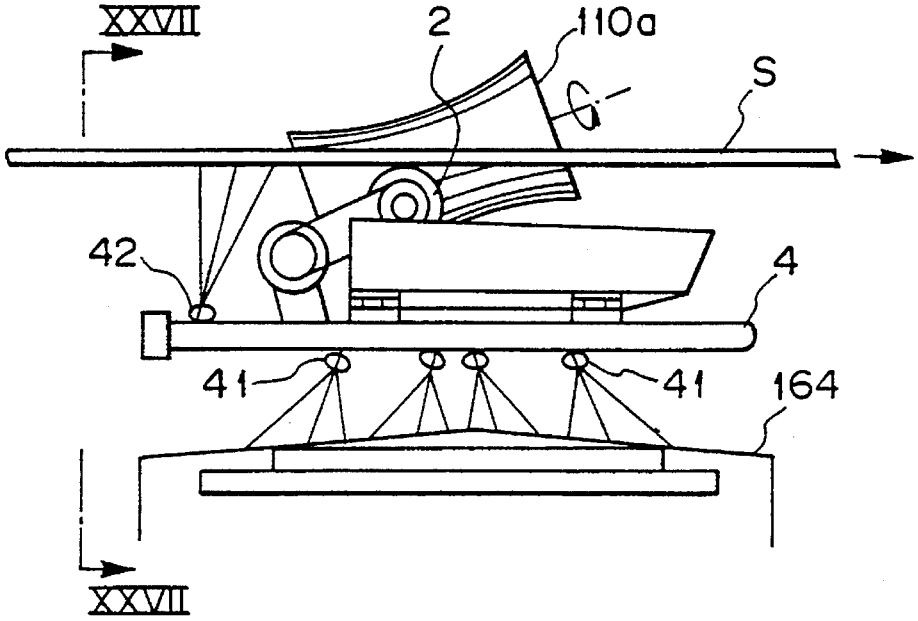
FIG. 26 is a side elevational view of an embodiment of a washing water spray unit.
Figure 27:
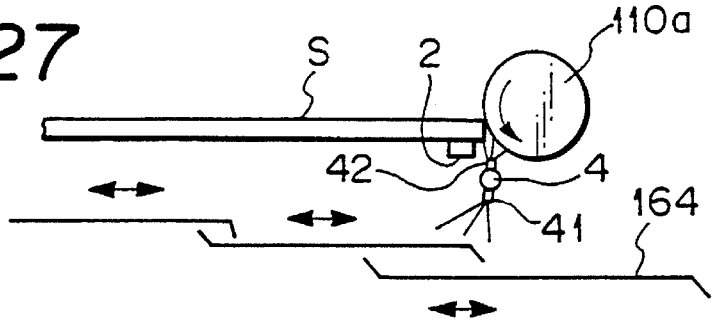
FIG. 27 is a front elevational view taken along lines XXVII—XXVII in FIG. 26.

Thus, in the present invention, the spray header 4 is provided at an area Immediately below the rotary brushes 110*a* , as shown in FIGS. 26 and 27, and spray nozzles 41 are provided in position on the spray header 4. High pressure water is sprayed through the spray nozzles 41. Spray nozzles 42 may be provided to orient toward an upward direction so as to remove foreign materials from the back surface of the steel strip.

This arrangement as described above prevents the rail covers 164 from being blocked, because water is constantly being sprayed upon the slidable rail covers 164 on the brush support carriage 163 in an area where the polishing dusts are most apt to fall.

The pressure of the cleaning water is preferably in the range of 0–4.0 $kg/cm^2$.

Figure 6:
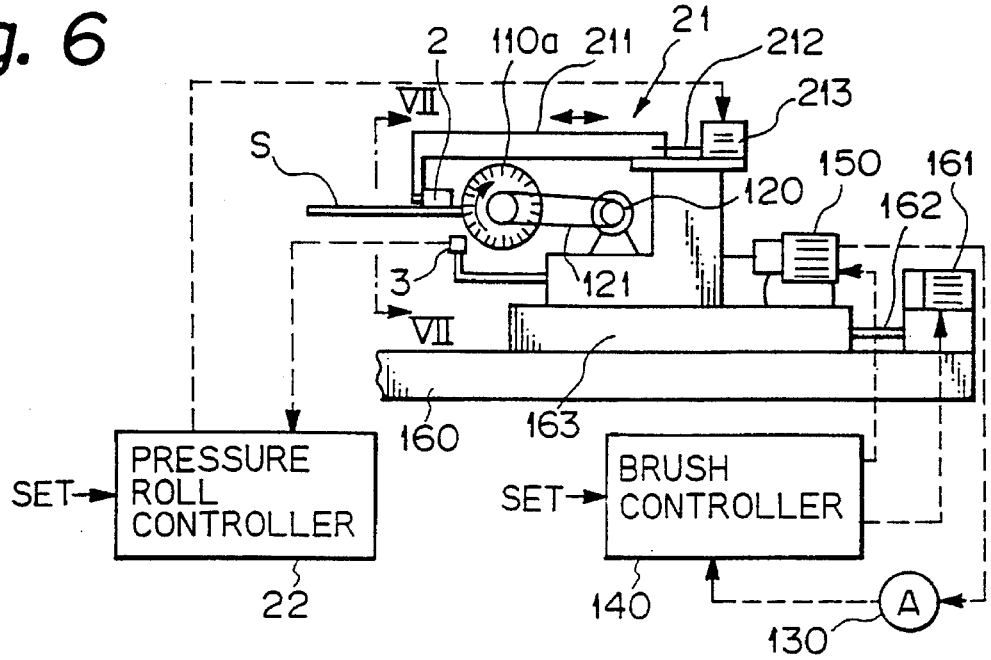
FIG. 6 is a front elevational view of a part of FIG. 1, illustrating a control unit of a pressure roll.
Figure 7:
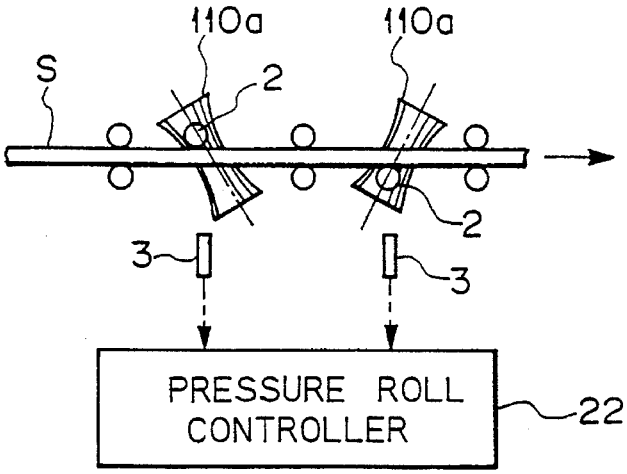
FIG. 7 is a side elevational view taken along lines VII—VII in FIG. 6.

In FIGS. 4 to 6, a conventional pan receptacle 166 is shown for receiving the polishing dust therein.

The present device may be provided with two units as one set such that the rotary brushes may retract toward the widthwise direction of the strip while maintaining itself to be in contact with the side face, but the device may be provided independently at a later stage in the plating line. Furthermore, the device can be used to polish the surface for a purpose other than removing an excessive plating.

Table 4 Indicates results of the polishing operation when the present system is used with various materials and dimensions.

TABLE 4

| Type of Plating | Dimensions | | Plating Weight ($g/m^2$) | Side Face State | |
|---|---|---|---|---|---|
| | Thickness (mm) | Width (mm) | | Prior Art | Present Invention |
| Pure Zinc Plating | 0.4–1.6 | 650–1600 | 0/10–0/100 (One Side) | ○ | ○ |
| | 0.4–1.6 | 650–1600 | 10/10–100/100 (Two Sides) | X | ○ |
| Zn—Ni Plating | 0.4–1.6 | 650–1800 | 0/10–0/40 (One Side) | Δ | ○ |
| | 0.4–1.6 | 650–1800 | 10/10–40/40 (Two Sides) | X | ○ |
| Zinc-Iron Plating | 0.4–1.6 | 650–1600 | 0/20 (One Side) | Δ | ○ |
| | 0.4–1.6 | 650–1600 | 0/20 (Two Sides) | X | ○ |

○ mark indicates that no plating material has been peeled off.
X mark indicates that some plating materials have been peeled off.
Δ mark indicates that a slightly good condition has been provided.

According to the present invention, the rail covers can move smoothly on the brush support table since the polished chips deposited on the rail cover are readily eliminated upon polishing the opposite edge faces of the electrically plated steel strip.

What is claimed is:

1. A polishing system for opposite edge faces of a plated steel strip wherein a plating layer on opposite edge faces of the plated steel strip is removed, comprising:

at least a pair of side face polishing devices disposed along a traveling direction of the steel strip for polishing opposite side faces of the steel strip by a pair of rotary brushes which engage with said opposite side faces in a widthwise direction, said rotary brushes having a substantially hourglass configuration, rotary axes of said rotary brushes of said devices opposed in the widthwise direction of the steel strip being inclined in the same direction relative to the traveling direction of the steel strip, one rotary brush on a side face of the steel strip being set to rotate downwardly thereon and the other adjacent rotary brush on the same side as the one rotary brush being set to rotate upwardly thereon in the case of providing more than two pairs of said side face polishing devices;

a warp adjusting mechanism for adjusting warps of edge portions of the steel strip, said warp adjusting mechanism being designed to form an upward ramp path and a downward ramp path in a pass line of a steel strip passing between the opposite rotary brushes by at least three path rolls provided in a given spaced distance in said pass line, to insulate tension caused in said upward and downward ramp paths from other paths by wringer rolls provided on inlet and outlet sides of said upward and downward ramp paths, and to rotate the rotary brushes downwardly or upwardly relative to the side face on said upward or downward ramp path;

a detector for detecting a change of a driving load in a motor which drives said rotary brush; and a controller for adjusting the position of said rotary brush by applying a control signal to a motor which moves said rotary brush in the widthwise direction of the steel strip response to the detected signal from said detector.

2. A polishing system according to claim 1, wherein said side face polishing are disposed on either said upward or downward ramp path.

3. A polishing system according to claim 1, wherein said side face polishing are disposed on both upward and downward ramp paths.

4. A polishing system according to any one of claims 1, 2 or 3, wherein said warp adjusting mechanism includes a pressure roll disposed on a lower or upper edge face of the steel strip when said rotary brush polishes the side face of the steel strip downwardly or upwardly.

5. A polishing system according to claim 4, wherein a polishing position detector is secured to a support table for said rotary brushes for detecting a polishing position between at least one rotary brush and the side face of the steel strip, wherein a roll displacing mechanism which displaces said pressure roll in the widthwise direction is secured to said brush support table, and wherein said controller transmits a control signal to said roll displacing mechanism in accordance with a detected signal from said polishing position detector.

6. A polishing system according to any one of claims 1, 2 or 3, wherein a spray nozzle is disposed below at least one rotary brush so that said nozzle removes polished chips deposited on sliding rail covers.

7. A polishing system for opposite longitudinal edge faces of a plated steel strip wherein a plating layer on opposite edge faces of the plated steel strip is polished, comprising:

at least two pairs of side face polishing devices disposed along a traveling direction of the steel strip for polishing opposite side faces of the steel strip by a pair of hourglass like rotary brushes which engage with said opposite side faces in a widthwise direction, rotary axes of said hourglass like rotary brushes of said devices opposed in the widthwise direction of the steel strip being inclined in the same direction relative to the traveling direction of the steel strip, rotary axes of said hourglass like rotary brushes adjacent to each other on the same side face of the steel strip being inclined in reverse directions to each other, one hourglass like rotary brush on a side face of the steel strip being set to rotate downwardly thereon and the other adjacent hourglass like rotary brush on the same side as the one brush being set to rotate upwardly thereon;

a pressure roll disposed on a lower or upper edge face of the steel strip when the side face of the steel strip is polished downwardly or upwardly;

a first pressure roll displacing mechanism for displacing said pressure roll in a direction perpendicular to a surface of the steel strip;

a second pressure roll displacing mechanism mounted on a brush support table for supporting said first mechanism and for displacing it in the widthwise direction of the steel strip;

a polishing load adjusting device mounted on a base for detecting a change of a driving load in a motor which drives said hourglass like rotary brushes and for displacing said brush support table in the widthwise direction of the steel strip to adjust a brush polishing load;

a polishing position detector mounted on said brush support table for detecting a polishing position between one of said hourglass like rotary brushes and the side face of the steel strip;

a pressure roll controller for controlling said second pressure roll displacing mechanism in response to a detected signal from said polishing position detector; and a warp detector mounted on said base plate for detecting a distance from an upper or lower edge face of the steel strip to the warp detector, said pressure roll controller controlling said first pressure roll displacing mechanism in response to a detected signal from said warp detector.

8. A polishing system for opposite edge faces of a plated steel strip wherein a plating layer on opposite edge faces on the plated steel strip is polished, according to one of claims 1 or 7, comprising: each side face polishing device including a pair of units having the same construction, said units including a brush support table which directs said rotary brush to the widthwise direction of the steel strip and a base table which supports said brush support table slidably to the widthwise direction;

rail covers slidably stacked on one after another, said covers being moved together with said brush support table;

a washing water spray unit disposed below said rotary brush and above said rail covers, a driving load change detector for detecting a change of a driving load in a motor which drives said rotary brush; and a controller for adjusting the position of said rotary brushes by applying a control signal to a motor which moves said rotary brushes in the widthwise direction of the steel strip in response to the detected signal from said driving load change detector.

* * * * *